US009060582B2

(12) United States Patent
Longoria et al.

(10) Patent No.: US 9,060,582 B2
(45) Date of Patent: Jun. 23, 2015

(54) HAIR STYLING SYSTEM AND APPARATUS

(71) Applicants: Jose Longoria, Miami, FL (US); Melvin R. Kennedy, Santa Barbara, CA (US); Robert G. Robbins, Boca Raton, FL (US)

(72) Inventors: Jose Longoria, Miami, FL (US); Melvin R. Kennedy, Santa Barbara, CA (US); Robert G. Robbins, Boca Raton, FL (US)

(73) Assignees: SPECTRUM ASSOCIATES, LLC, Boca Raton, FL (US); KENNEDY-MATSUMOTO DESIGN, LLC, Santa Barbara, CA (US); LONGORIA DESIGN, LLC, Miami, FL (US)

( * ) Notice: Subject to any disclaimer, the term of this patent is extended or adjusted under 35 U.S.C. 154(b) by 0 days.

(21) Appl. No.: 14/280,183

(22) Filed: May 16, 2014

(65) Prior Publication Data

US 2014/0338692 A1 Nov. 20, 2014

Related U.S. Application Data

(60) Provisional application No. 61/855,476, filed on May 16, 2013.

(51) Int. Cl.
*A45D 6/02* (2006.01)
*A45D 6/04* (2006.01)
(Continued)

(52) U.S. Cl.
CPC .. *A45D 2/12* (2013.01); *A45D 2/00* (2013.01); *A45D 2002/007* (2013.01); *A45D 2002/006* (2013.01)

(58) Field of Classification Search
CPC ..... A45D 2002/003; A45D 2002/005; A45D 2002/006; A45D 2002/007; A45D 2002/008; A45D 2007/002; A45D 2/00; A45D 2/12
USPC ..... 132/238, 212, 119.1, 226, 239, 333, 132/270, 332, 56, 120, 317, 320, 148, 210, 132/271; 87/3, 8, 24, 25, 33, 40, 45; 112/169, 221; 57/3, 4, 5, 10, 28, 29, 57/13; 242/442, 470, 475.3, 422.5, 593, 242/594; 119/600, 601, 607–609, 611–616, 119/625; 15/22.1, 34, 176.1, 202; 173/29, 173/30, 46, 214; 219/225, 227, 238
See application file for complete search history.

(56) References Cited

U.S. PATENT DOCUMENTS 352,804 A 11/1886 Bowersox
359,409 A 3/1887 Stone
(Continued)

FOREIGN PATENT DOCUMENTS

EP 0538169 4/1993
WO WO 2005082198 A1 * 9/2005 ..... A45D 1/06

*Primary Examiner* — Vanitha Elgart
(74) *Attorney, Agent, or Firm* — Akerman LLP

(57) ABSTRACT

A hair styling system includes a driver module and a plurality of interchangeably receivable styling modules. The driver module includes a holder configured to interchangeably receive a plurality of styling modules, each configured to perform at least one styling operation, a driver gear positioned adjacent to the holder, and a power module comprising a motor configured to drive the driver gear in a first direction and a second direction. The plurality of interchangeably receivable styling modules each include a styling module gear configured to operatively engage the driver gear and be rotatable thereby to perform at least one styling operation distinguishable from a styling operation performed by at least one other styling module.

18 Claims, 14 Drawing Sheets

(51) Int. Cl.

| | |
|---|---|
| ***A45D 7/02*** | (2006.01) |
| ***A45D 20/08*** | (2006.01) |
| ***A45D 2/12*** | (2006.01) |
| ***A45D 2/00*** | (2006.01) |

(56) References Cited

U.S. PATENT DOCUMENTS

| | | | | | |
|---|---|---|---|---|---|
| 433,855 | A | | 8/1890 | Ellis | |
| 739,461 | A | | 9/1903 | Warren | |
| 830,137 | A | | 9/1906 | Diss | |
| 1,048,687 | A | | 12/1912 | Goodrick | |
| 1,392,611 | A | | 10/1921 | Adams | |
| 1,398,444 | A | | 11/1921 | Pfrunder | |
| RE15,909 | E | | 9/1924 | Pfrunder | |
| 1,927,261 | A | | 9/1933 | Evans | |
| 1,992,281 | A | | 2/1935 | Arnold | |
| 2,118,920 | A | | 5/1938 | Gentile | |
| 2,254,895 | A | | 9/1941 | Johnston, Jr. | |
| 2,764,985 | A | | 10/1956 | Papish | |
| 2,782,590 | A | | 2/1957 | Lowe | |
| 2,785,689 | A | | 3/1957 | Trabish | |
| 2,878,514 | A | | 3/1959 | Nichols et al. | |
| 3,259,370 | A | | 7/1966 | Neale, Sr. | |
| 3,360,915 | A | | 1/1968 | Franzen | |
| 3,421,406 | A | | 1/1969 | Mitchell et al. | |
| 3,439,486 | A | | 4/1969 | Klein | |
| 3,552,693 | A | | 1/1971 | Scherf | |
| 3,834,146 | A | | 9/1974 | Nessler et al. | |
| 3,863,652 | A | | 2/1975 | Scivoletto | |
| 3,890,984 | A | | 6/1975 | Lesetar | |
| 4,013,500 | A | | 3/1977 | Koput et al. | |
| 4,038,996 | A | * | 8/1977 | Eronini et al. | 132/271 |
| 4,130,122 | A | | 12/1978 | Kennedy | |
| 4,192,326 | A | * | 3/1980 | Klinge | 132/238 |
| 4,222,398 | A | | 9/1980 | Fromman | |
| 4,262,479 | A | | 4/1981 | Lenorak | |
| 4,307,737 | A | | 12/1981 | Shipman | |
| 4,346,550 | A | | 8/1982 | Ferree | |
| 4,369,690 | A | * | 1/1983 | Sapkus | 87/33 |
| 4,427,017 | A | * | 1/1984 | Eronini | 132/271 |
| 4,580,585 | A | * | 4/1986 | Sapkus | 132/212 |
| 4,582,074 | A | | 4/1986 | Schwager et al. | |
| 4,583,561 | A | * | 4/1986 | Larsson | 132/212 |
| 4,664,132 | A | | 5/1987 | Schillig | |
| 4,717,364 | A | | 1/1988 | Furukawa | |
| 4,824,036 | A | | 4/1989 | Buta | |
| 4,829,156 | A | | 5/1989 | Thompson | |
| 4,856,721 | A | | 8/1989 | Bonello et al. | |
| 5,119,847 | A | | 6/1992 | Powell et al. | |
| 1,900,310 | A | | 3/1993 | Somerville | |
| 5,456,271 | A | | 10/1995 | Legette | |
| 5,488,963 | A | | 2/1996 | Fishman | |
| 5,497,795 | A | | 3/1996 | Hibbard | |
| 5,558,105 | A | | 9/1996 | Rosenwinkel et al. | |
| D374,305 | S | | 10/1996 | Erickson et al. | |
| 5,575,297 | A | | 11/1996 | Hatchett et al. | |
| 5,671,759 | A | * | 9/1997 | Chung et al. | 132/271 |
| 5,725,000 | A | | 3/1998 | Rice | |
| 5,810,022 | A | | 9/1998 | Reynolds | |
| 5,834,040 | A | | 11/1998 | Israel et al. | |
| 5,904,087 | A | * | 5/1999 | Freitas et al. | 87/54 |
| 5,967,151 | A | | 10/1999 | Villani et al. | |
| 5,988,181 | A | * | 11/1999 | Gable et al. | 132/210 |
| 6,109,275 | A | * | 8/2000 | Mendezmonsanto | 132/212 |
| 6,164,289 | A | | 12/2000 | Ogunro et al. | |
| 6,318,378 | B1 | * | 11/2001 | Kennedy et al. | 132/212 |
| 6,499,491 | B2 | * | 12/2002 | Kennedy et al. | 132/212 |
| 6,520,187 | B1 | * | 2/2003 | Lee et al. | 132/212 |
| 6,575,175 | B2 | * | 6/2003 | Kim et al. | 132/210 |
| 6,615,846 | B1 | * | 9/2003 | Leason et al. | 132/212 |
| 6,627,852 | B1 | * | 9/2003 | Savone | 219/225 |
| 6,637,441 | B2 | * | 10/2003 | Kennedy et al. | 132/212 |
| 6,662,808 | B2 | * | 12/2003 | Leason et al. | 132/212 |
| 7,069,935 | B2 | * | 7/2006 | Bousfield et al. | 132/210 |
| 7,905,237 | B2 | * | 3/2011 | Noh | 132/212 |
| 8,087,414 | B2 | * | 1/2012 | Gutierrez Ugarte | 132/212 |
| 8,607,804 | B2 | * | 12/2013 | De Benedictis | 132/237 |
| 2003/0192564 | A1 | * | 10/2003 | Johnson | 132/119.1 |
| 2004/0237991 | A1 | * | 12/2004 | Glucksman et al. | 132/271 |
| 2006/0168746 | A1 | * | 8/2006 | Guyuron et al. | 15/97.1 |
| 2008/0173322 | A1 | * | 7/2008 | Leung | 132/232 |
| 2008/0230246 | A1 | * | 9/2008 | Dollar-Wright | 173/29 |
| 2009/0283108 | A1 | * | 11/2009 | Brouillard | 132/212 |
| 2012/0325262 | A1 | * | 12/2012 | Sansole et al. | 132/210 |
| 2013/0118767 | A1 | * | 5/2013 | Cannaliato et al. | 173/29 |

* cited by examiner

HAIR STYLING SYSTEM AND APPARATUS

CROSS-REFERENCE TO RELATED APPLICATIONS

This application is related to, and claims priority from, co-pending U.S. Provisional Patent Application No. 61,855,476, filed May 16, 2013 by the present inventors Jose Longoria and Melvin R. Kennedy, and entitled Hair Styling Device Combining Twining and Wrapping, the contents of which is hereby incorporated by reference in its entirety.

FIELD OF THE INVENTION

This invention relates generally to devices for styling hair, and more particularly to an apparatus for selectively twirling or wrapping hair.

BACKGROUND

Hair styling techniques include gathering or bunching hair via curling, pinning, braiding, twisting, twirling, and even wrapping the gathered or bunched hair. For example, one braiding technique traditionally includes interweaving three or more strands of hair in a diagonal overlapping pattern. The completed braid extends from a starting position near the scalp to the end of the hair where it may be prevented from unraveling with a device such as a clip or a rubberband. Many forms of hair braiding, beading, and other hair decorations are known. One of the known forms of hair decoration is hair wrapping, where a lock of hair is wrapped with a decorative cord. Hair wrapping is usually performed manually, which can be a long and laborious process. A number of devices have been devised to assist in styling hair. These devices however are generally limited in the types of styling they may be used to perform. What are needed are multi-purpose styling devices and systems that may assist users in styling hair.

SUMMARY

In one aspect, a hair styling system includes a driver module and a plurality of interchangeably receivable styling modules. The driver module includes a holder configured to interchangeably receive a plurality of styling modules, each configured to perform at least one styling operation, a driver gear positioned adjacent to the holder, and a power module comprising a motor configured to drive the driver gear in a first direction and a second direction. The plurality of interchangeably receivable styling modules each include a styling module gear configured to operatively engage the driver gear and be rotatable thereby to perform at least one styling operation distinguishable from a styling operation performed by at least one other styling module.

The styling module gear of each of the plurality of styling modules is configured to rotate in a third direction when the driver gear is driven in the first direction and in a fourth direction when the driver gear is driven in the second direction. The plurality of interchangeably receivable styling modules comprises a first and second styling module. The first styling module comprises a first styling module gear. The first styling module is configured to perform a first styling operation when the first styling module gear is rotated in at least one of the third direction and the fourth direction. The second styling module comprises a second styling module gear. The second styling module is configured to perform at least one of a second styling operation when the second styling module gear is rotated in the third direction and a third styling operation when the second styling module gear is driven in the fourth direction. The second styling module may also be configured to perform both the second and third styling operations, wherein the first styling operation, the second styling operation, and the third styling operation are distinguishable. The first styling operation may comprise wrapping a lock of hair with a cord when the first styling module gear is rotated in at least one of the third direction and the fourth direction. The second styling operation may comprise twisting at least two separate locks of hair when the second styling module gear is rotated in the third direction. The third styling operation may comprise twining at least two separate locks of hair together when the second styling module gear is rotated in the fourth direction. The first styling module may further comprise a rotation body rotationally coupled to the first styling module gear and a spool rotatably mounted with respect to the first styling module gear and rotation body. The spool may be configured to retain a length of cord configured to be dispensed from the spool when the spool rotates relative to the rotation body and be threaded through a slot defined on the rotation body such that rotation of the rotation body rotates the cord with the rotation of the rotation body to wrap the cord about a lock of hair.

The second styling module may further comprise a shaft, a rotation body, and at least a first and second twist assembly. The shaft may be rotationally coupled to the second styling module gear. The shaft and the second styling module gear may be configured to rotate in a third direction relative to the holder when the driver gear is driven in the first direction and in a fourth direction relative to the holder when the driver gear is driven in the second direction. The rotation body may be rotatably coupled to the second styling module gear and shaft. The at least a first and second twist assembly may each comprise a grabber configured to grab one or more locks of hair. The first and second twist assemblies are each drivable by rotation of the shaft to rotate about a respective first and second twist axis to perform the second styling operation. The first and second twist assemblies are rotationally coupled to the rotation of the rotation body to co-rotate about a third axis when the rotation body rotates relative to the holder to perform the third styling operation. The second styling module may be received by the holder and include one or more directional clutches configured to decouple rotation of the second styling module gear from the rotation body when the second styling module gear is rotated in the third direction to perform the second styling operation and couple rotation of the second styling module gear to the rotation body when the second styling module gear is rotated in the fourth direction to perform the third styling operation.

When the second styling module is received by the holder, the hair styling system comprises a decoupling module configured to engage to decouple rotation of the second styling module gear relative to the rotation body when the second styling module gear is rotated in the third direction and to disengage to allow coupled rotation of the second styling module gear and rotation body when the second styling module gear is rotated in the fourth direction. The decoupling module comprises at least one first clutch arm extending from the driver module and configured to engage at least one first stop defined on the rotation body when the second styling module is received by the holder. The at least one first stop comprises a groove extending to an abutment surface configured to cooperatively engage with an engagement portion of the clutch arm to oppose rotation of the rotation body in a fifth direction about the third axis relative to the holder when the second styling module gear is rotated in the third direction. The at least one clutch arm is configured to pass over the groove and abutment surface to allow rotation of the rotation body relative to the holder in a sixth direction when the second styling module gear is rotated in the fourth direction. The third direction may correspond to the fifth direction and the fourth direction may correspond to the sixth direction.

The second styling module may further comprise a coupling module configured to engage to couple rotation of the second styling module gear to the rotation body when the second styling module gear is rotated in the fourth direction and to disengage to allow decoupled rotation of the second styling module gear relative to the rotation body when the second styling module gear is rotated in the third direction. The coupling module may comprise at least one clutch arm extending between the second styling module gear and the rotation body and at least one stop comprising an abutment surface configured to be engaged by an engagement portion of the at least one clutch arm when the second styling module gear is rotated in the fourth direction to couple the rotation of the second styling module gear to the rotation body. The at least one clutch arm and the at least one stop are dimensioned for passage of the engagement portion with respect to the at least one stop when the second styling module gear is rotated in the third direction to allow decoupled rotation of the second styling module gear with respect to the rotation body. The at least one stop comprises a groove and an abutment surface. The groove may be defined in a surface of the rotation body and include a depth with respect to the surface of the rotation body that increases from a first end to a second end. The abutment surface may be formed at the second end of the groove. The at least one clutch arm may be mounted on the second styling module gear and be configured to be biased into the groove to engage the abutment surface when the second styling module gear is rotated in the fourth direction to couple rotation of the second styling module gear with the rotation body. The at least one second clutch arm may slide along the surface of the rotation body, over the engagement surface, and through the groove when the second styling module gear is rotated in the third direction relative to the rotation body.

When the second styling module is received by the holder, the hair styling system may comprises a decoupling module and a coupling module. The decoupling module may comprise at least one clutch arm configured to engage to decouple rotation of the second styling module gear relative to the rotation body when the second styling module gear is rotated in the third direction and to disengage to allow coupled rotation of the second styling module gear and rotation body when the second styling module gear is rotated in the fourth direction. The coupling module may comprise at least one clutch arm configured to engage to couple rotation of the rotation body and the second styling module gear when the second styling module gear is rotated in the fourth direction and to disengage to allow decoupled rotation of the second styling module gear relative to the rotation body when the second styling module gear is rotated in the third direction. The driver module may further comprise a latch positioned adjacent to the holder and configured to be biased toward a surface of a styling module received therein. The latch may be operatively coupled to an actuator configured to counter bias the latch away from the surface of the styling module when actuated. When the first styling module is received by the holder, the latch is configured to oppose a lip defined on an outer surface of the first styling module to retain the first styling module on the holder. When the second styling module is received by the holder, the latch comprises the at least one first clutch arm.

In another aspect, a hair styling apparatus comprises a driver module and a plurality of interchangeably receivable styling modules. The driver module comprises a holder, a driver gear, and a power module. The holder is configured to interchangeably receive a plurality of styling modules, each configured to perform at least one styling operation. The driver gear may be positioned adjacent to the holder. The power module may comprise a motor configured to drive the driver gear in a first direction and a second direction. The plurality of interchangeably receivable styling modules each comprise a styling module gear configured to operatively engage the driver gear and be rotatable thereby to perform at least one styling operation distinguishable from a styling operation performed by at least one other styling module. The styling module gear of each of the plurality of styling modules is configured to rotate in a third direction when the driver gear is driven in the first direction and in a fourth direction when the driver gear is driven in the second direction. The plurality of interchangeably receivable styling modules may comprise a first and a second styling module. The first styling module comprises a first styling module gear. The first styling module may be configured to perform a first styling operation when the first styling module gear is rotated in at least one of the third direction and the fourth direction. The second styling module comprises a second styling module gear. The second styling module may be configured to perform a second styling operation when the second styling module gear is rotated in the third direction and a third styling operation when the second styling module gear is driven in the fourth direction. The second styling module may further comprise a shaft, a rotation body, and at least a first and second twist assembly. The shaft is rotationally coupled to the second styling module gear. The shaft and the second styling module gear are configured to rotate in a third direction relative to the holder when the driver gear is driven in the first direction and in a fourth direction, opposite the third direction, relative to the holder when the driver gear is driven in the second direction. The rotation body is rotatably coupled to the second styling module gear and shaft. The at least a first and second twist assembly each comprise a grabber configured to grab one or more locks of hair. The first and second twist assemblies are each drivable by rotation of the shaft to rotate about a respective first and second twist axis independent of a rotation of the rotation body to perform the second styling operation when the second styling module gear is rotated in the third direction. The first and second twist assemblies are rotationally coupled to the rotation of the rotation body to co-rotate about a third axis when the rotation body rotates relative to the holder to perform the third styling operation when the second styling module gear rotates in the fourth direction. The driver module may further comprise a latch positioned adjacent to the holder and configured to be biased toward a surface of a styling module received therein. The latch is operatively coupled to an actuator configured to counter bias the latch away from the surface of the styling module when actuated. The first styling module is received by the holder and the latch is configured to oppose a lip defined on an outer surface of the first styling module to retain the first styling module on the holder. When the second styling module is received by the holder, the latch comprises a clutch arm configured to engage a stop defined in a surface of the second styling module to decouple rotation of second styling module gear with respect to the rotation body when the second styling module gear is rotated in the third direction.

In still another aspect, a hair styling module comprises a styling module gear, a shaft rotationally coupled to a styling module gear, a rotation body rotatably coupled to the styling module gear and shaft and rotatable about a rotation axis, and at least a first and a second twist assembly rotatable about a respective first and second twist axis when the styling module gear and shaft rotate relative to the rotation body to perform a first styling operation. The first and second twist assemblies are rotationally coupled to the rotation body to co-rotate about the rotation axis when the rotation body rotates about the rotation axis to perform a second styling operation. The hair styling module is configured to be selectively received by a driver module comprising a holder, a driver gear, and a power module. The holder is configured to interchangeably receive the styling module and at least one other styling module, each configured to perform at least one styling operation. The driver gear is positioned adjacent to the holder and configured to drivably engage the styling module gear when the hair styling module is received by the holder. The power module comprises a motor configured to drive the driver gear to rotate the styling module gear in the first direction to perform the first styling operation and the second direction to perform the second styling operation.

The hair styling module further comprises a coupling assembly configured to allow relative rotation between the styling module gear and the rotation body when the styling module gear is rotated in a first direction and to couple rotation of the styling module gear to the rotation body when the styling module gear is rotated in a second direction. The hair styling module may further comprise a decoupling assembly portion configured to cooperatively interface with a second decoupling assembly portion attached to the holder when the hair styling module is received thereby to couple with the driver module. The decoupling assembly portion may comprise a stop having a groove and an abutment surface positioned on an outer surface of the rotation body. The second decoupling assembly portion may comprise a clutch arm configured to be biased into the groove such that the abutment surface catches the clutch arm when the styling module gear is rotated in the first direction to prevent the rotation body from rotating in the first direction with the styling module gear. The stop may be configured to counter bias the clutch arm when the styling module gear is rotated in the second direction to allow the rotation of the styling module gear in the second direction to be coupled to the rotation body.

BRIEF DESCRIPTION OF THE DRAWINGS

There are presently shown in the drawings embodiments which are presently preferred, it being understood, however, that the invention is not limited to the precise arrangements and instrumentalities shown, wherein.

DETAILED DESCRIPTION

There are hair styling devices configured to cable hair, such as the devices described in U.S. Pat. No. 6,499,491, the contents of which are herein incorporated by reference in their entirety. There are also hair styling devices configured to wrap hair, such as the devices described in U.S. Pat. No. 6,637,441, the contents of which are herein incorporated by reference in their entirety. The above cabling and wrapping devices are separate devices. The present description describes a convenient, attractive, and less expensive option for consumers for incorporating the above cabling and wrapping operations into a hair styling device and system comprising a plurality of hair styling modules for performing these or other hair styling operations.

Figure 1:
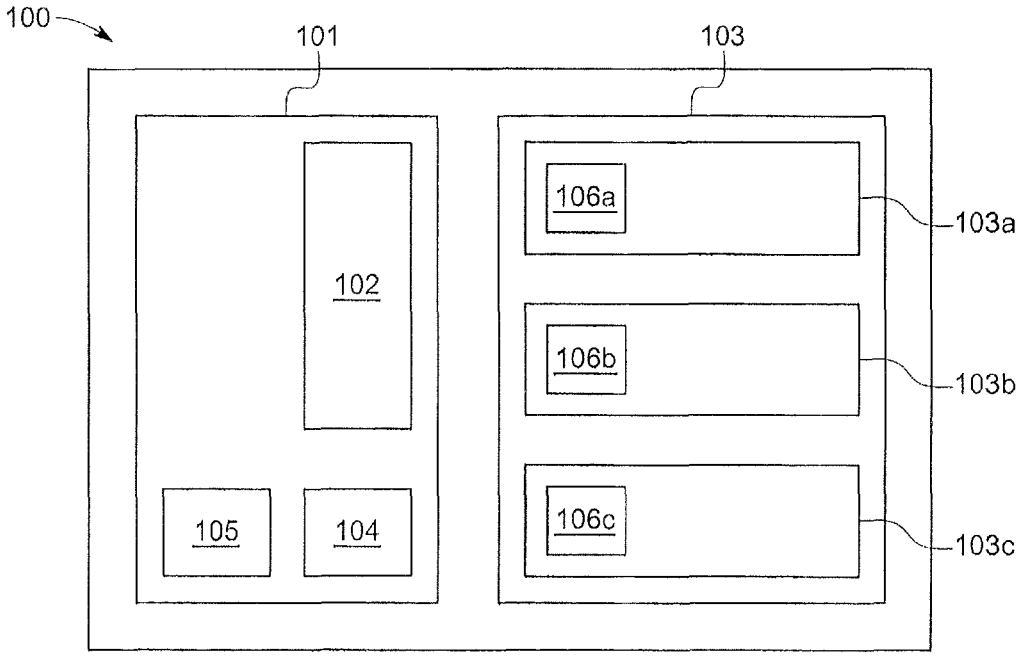
FIG. 1 is a schematic depiction of a hair styling system according to various embodiments described herein.

FIG. 1 schematically illustrates a hair styling system 100 according to various embodiments described herein. The hair styling system 100 includes a driver module 101. The driver module 101 may comprise a holder 102 configured to interchangeably receive a plurality of different styling modules 103. Each styling module 103*a*, 103*b*, 103*c* may be configured to perform at least one styling operation when received and operated by the driver module 101. The driver module 101 may be configured to operate or drive each of the styling modules 103*a*, 103*b*, 103*c* via a driver gear 104 positioned adjacent to the holder 102. The driver module 101 may also comprise a power module 105 comprising a motor configured to drive the driver gear 104 in a first direction and a second direction. In some embodiments, the power module 105 may include a power source such as a battery or connection to an external power source. The styling modules 103*a*, 103*b*, 103*c* may include modular heads that may be selectively coupled to the driver module 101 at the holder 102 and thereon driven to perform a hair styling operation. Each styling module 103*a*, 103*b*, 103*c* includes various working parts that may be attached, detached, or interchanged with the driver module 101 to complete a hair styling unit. In various embodiments, the system 100 includes a plurality of interchangeably receivable styling modules 103*a*, 103*b*, 103*c* each comprising a styling module gear 106*a*, 106*b*, 106*c* configured to operatively engage the driver gear 104 and be rotatable thereby to perform at least one styling operation distinguishable from at least one other styling module 103*a*, 103*b*, 103*c*. Each of the styling modules 103*a*, 103*b*, 103*c* may perform one or more hair styling functions such as bunching, twisting, twining, rotating, or wrapping of hair. While two styling modules 103*a*, 103*b*, 103*c* are described herein in detail, additional styling modules 103*a*, 103*b*, 103*c* may be configured for operative coupling with the driver module 101 to provide additional hair styling units. For example, in one embodiment, a styling module 103*a*, 103*b*, 103*c* may include a retractable loop driven by the driver module 101 to capture or bunch hair when the loop is retracted or constricted.

Figure 2:
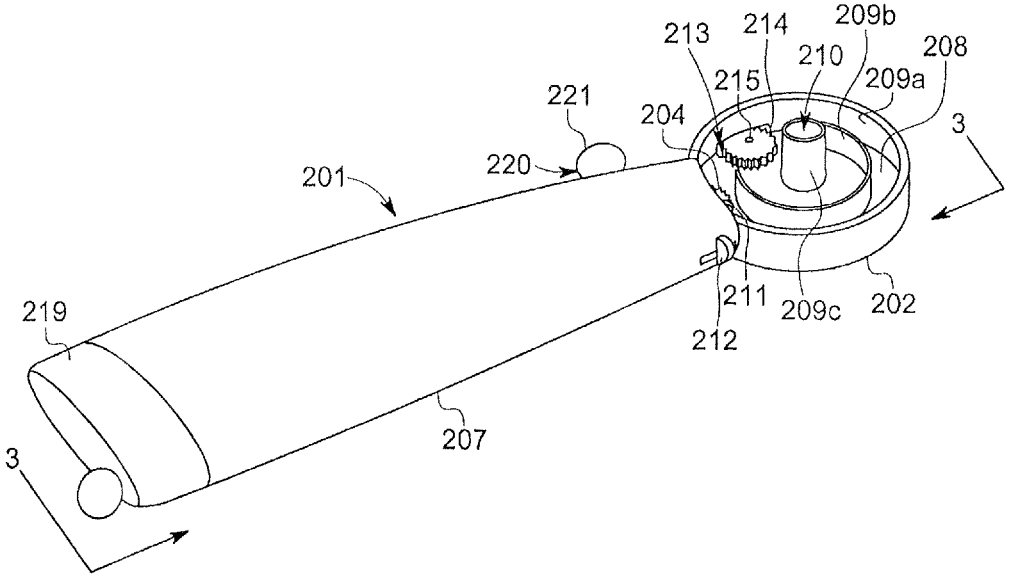
FIG. 2 illustrates a driver module according to various embodiments described herein.
Figure 3A:
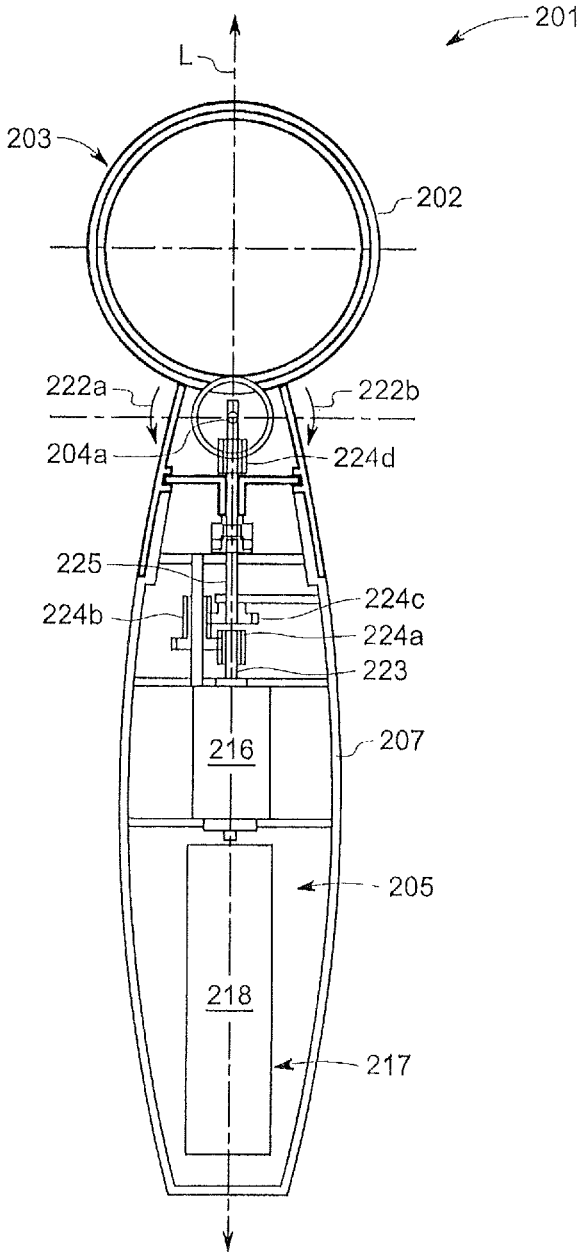
FIG. 3A is a cross-section along line 3-3 of the driver module illustrated in FIG. 2 according to various embodiments described herein.
Figure 3B:
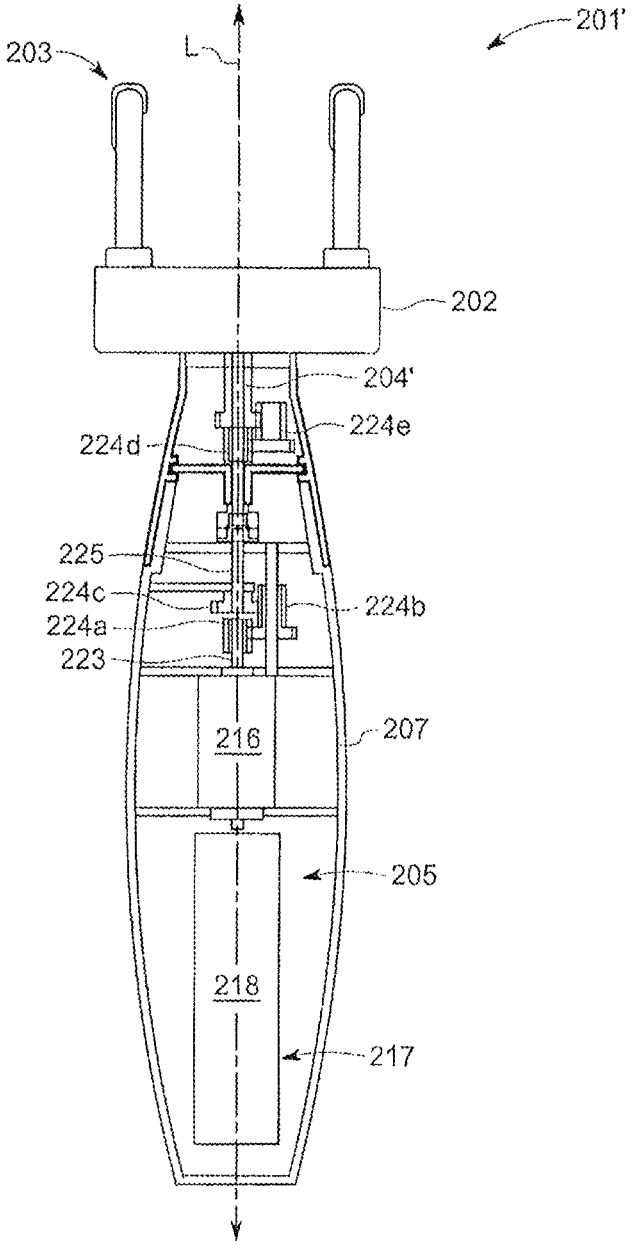
FIG. 3B is a cross-section of an alternate embodiment of the driver module according to various embodiments described herein.

FIG. 2 is a perspective view of a driver module 201 according to various embodiments described herein. FIG. 3A is a cross-section along line 3-3 of the driver module illustrated in FIG. 2. The driver module 201 includes a housing 207 having and a generally laterally orientated holder 202 with respect to a longitudinal axis L of the housing 207. The housing 207 may comprise any suitable material, such as plastic or metal, and may include any suitable shape or design of housing 207 or holder 202. In one embodiment, the housing 207 is ergonomically shaped to provide a comfortable handle for a user to grip. FIG. 3B is a cross-section of an alternate embodiment of the driver module 201' wherein the holder 202 is positioned at a different angle with respect to the longitudinal axis L of the housing 207 such that the holder 202 is configured to longitudinally receive styling modules 203 thereon. The styling module 203 shown in FIG. 3B may be any styling module 203 and the holder 202 of both FIGS. 3A and 3B may be similarly dimensioned and structured to interchangeably receive the same styling modules 203. However, some users may prefer different orientations of the styling modules 203 with respect to the housing 207. Thus, in various embodiments, the holder 202 may be oriented laterally, longitudinally, vertically, or at angles in between. In one embodiment, the holder 202 may be selectively angulated from a first angular position to a second angular position to allow a user to customize the styling system for a particular styling module 203. Angulation may extend between the longitudinal axis L and a lateral position 90° from the longitudinal axis L or anywhere in-between.

The holder 202 of FIGS. 3A & 3B is configured to selectively receive and operatively couple a plurality of interchangeable styling modules 203, e.g., styling modules 103*a*, 103*b*, 103*c*. The holder 202 may include any suitable shape configured to receive or hold styling modules and may include various engagement tabs, grooves, friction surfaces, or the like to achieve such purpose. In general, the holder 202 includes one or more complementary surfaces or dimensions to the styling modules configured to cooperatively receive and hold the styling modules. In the illustrated embodiment, the holder 202 includes a base 208 from which one or more walls extend 209*a*, 209*b*, 209*c*. The one or more walls 209*a*, 209*b*, 209*c* may comprise arcuate extensions extending from the base 208 configured to engage, retain, or guide one or more styling modules. Depending on the configuration or styling module, the one or more walls 209*a*, 209*b*, 209*c* may be configured with various engagement tabs, grooves, friction surfaces, or the like to assist in retaining styling modules when received by the holder 202. For example, a styling module may include a compressible dimension configured for compressive or friction fit with a complementary dimension of the one or more walls 209*a*, 209*b*, 209*c* or engagement tab, groove, or other friction surface. In one embodiment, a styling module includes a compressible dimension configured to be received within the grooves formed between the base 208 and the one or more walls 209*a*, 209*b*, 209*c*. In one such embodiment, a styling module includes a compressible ring configured to be received within a central aperture 210 defined by wall 209*c*, which may form a sleeve extending around the aperture 210, or possibly the base 208. A lip or groove may be provided such that the compressible dimension may be retained there along, e.g., ride or move along the groove during an operation of the styling module. The compressible ring may be compressed to extend through a reduced circumference of the aperture 210 for a friction fit while compressed or at a position beyond the reduced circumference having an increased circumference with respect to the reduced circumference defined by the wall 209*c* or base 208. The driver module 201 also includes a tab 211 configured to latch or compress against or be received between one or more styling module surfaces. Similar to the other various driver module features described herein, the tab 211 may be configured to perform multiple operations depending on the styling module coupled to the holder 202. For example, in one embodiment, the tab 211 is configured to compress against a surface of a styling module, e.g., within a groove formed along a surface of the styling module, to latch or assist in retention of the styling module. The tab 211 may be biased into position by a spring (not shown). An actuator 212 may also be provided along the handle 207 to allow a user to counter bias the tab toward the housing 210 for coupling and decoupling styling modules, which may also reduce mechanical damage to the tab 211 or styling modules. In some arrangements, the actuator 212 may not be necessary, and where provided, may be of any suitable form.

The driver module also includes a slot 213 defined in the outer wall 209*a* and a thumb gear 214 is positioned therethrough. The thumb gear 214 is configured to be rotatable about a pin 215 relative to the driver module 201 or base 208 and partially extends beyond the wall 209*a* such that a user may interface with the thumb gear 214 for operatively incorporating hair styling operations. The particular hair styling operation may depend on the styling module coupled to the driver module 201. As such, the thumb gear 214 may be multi-purposed to perform a variety of hair styling operations by operatively coupling to different features of styling modules. In one embodiment, the thumb gear 214 may be configured to engage a gear of a hair styling module for manually performing a hair styling operation. For example, in one embodiment, a styling module includes a first styling module as described below for wrapping hair, and includes a rotatable spool for retaining, dispensing, or letting out wrapping cord. The spool may be rotationally coupled to a spool gear configured to operatively engage the thumb gear 214 when the first styling module is received by the holder 202. Rotating or limiting rotation of the thumb gear 214 about the pin 215 may cooperatively interface with a wrapping operation or be used to spool, dispense, let out, or retain lengths of wrapping cord. The thumb gear 214 may protrude partially out of the slot 213, and in the illustrated embodiment does not extend beyond the outer wall 209*a*. In some arrangements, however, the thumb gear 214 may extend partially beyond the outer wall 209*a*. As shown, the slot 213 is also partially defined by the base 208 to allow ease of access from a back side of the holder 202. In certain configurations, the thumb gear 214 may be optional.

In various embodiments, the driver module 201 comprises a power module 205 including a motor 216 and power source 217 configured to power the motor 216. In various embodiments, the power source 217 comprises a battery 218. The battery 218 may be configured to be received within the housing 207 for electrical coupling to the motor 216. The housing 207 may be made in two or more parts for ease of manufacture, and may be held together with one or more fasteners or caps 219.

The driver module 201 further comprises a power switch 220 actuatable to couple the motor 216 and power source 217 to provide power to drive the motor 216. Driving the motor 216 ultimately drives rotation of at least one gear, generically referred to as the driver gear 204, rotatable about pin 204*a* in a first direction 222*a* and a second direction 222*b*, and that cooperatively interfaces or engages a styling module gear (not shown) to transmit rotation of the motor 216 to the styling module gear. In various embodiments, depending on the arrangement, the driver gear 204 may be a drive or driven gear, or in some ways an idler gear when engaged with a styling module gear to transfer rotation to that gear.

In various embodiments, the power switch 220 includes a control module for directing amount and direction of electrical current supplied to the motor 216. In some embodiments, the power switch 220 includes a control module for positioning one or more gears to control a power output with respect to degree or direction of movement or rotation. In various embodiments, the power switch 220 includes a first power switch to drive the motor 216 in a first direction and a second power switch to drive the motor 216 in a second direction. In another embodiment, actuating the power switch 220 drives the motor 216 and hence the driver gear 204 in a first direction 222*a* and a gearing system including a reverse idler gear, for example, is used such that one or more gears may be selectively engaged, via an actuator associated with the driver module 201, with one or more gears operatively coupled to the motor 216 to drive the driver gear 204 in a second direction 222*b*. In another embodiment, the driver module 201 comprises a power module 205 including multiple motors 216 selectively powerable via one or more power switches 220 to selectively drive the driver gear 238 or additional driver gears in a first direction 222*a* and then in a second direction 222*b*, depending on the motor 216 powered. Any suitable form of operating button or mechanism may be provided for actuating the power switch 220. In the illustrated embodiment, a lever 221 is operatively coupled to the power switch 220. Actuation of the lever 221 to a first position is configured to power the motor 216 to drive rotation of the driver gear 204 in a first direction 222*a* and actuation of the lever 221 to a second position is configured to power the motor 216 to drive rotation of the driver gear 216 in a second direction 222*b*. In some embodiments, actuating the lever 221 to the first position comprises actuation of the lever 221 toward the holder 202 and actuation of the lever 221 to the second position comprises actuation of the lever 221 away from the holder 202. In one arrangement, movement of the lever 221 to the first position operates the motor 216 in a forward direction and movement of the lever 221 to the second position operates the motor 216 in a reverse direction. In certain embodiments, the driver module 201 may be configured to drive rotation at multiple speeds in one or both directions 222*a*, 222*b* depending on a degree of actuation of the lever 221.

The battery 218 and motor 216 are housed within the housing 207. The motor 216 may be any suitable motor, including a reversible motor and may operatively connect to the power switch 220 and lever 221 as described above. In the illustrated embodiment, the motor 216 may include an output shaft 223 connected to a first gear 224*a*. The first gear 224*a* may be configured to drive a second gear 224*b*, which in turn may drive a third gear 224*c* to rotate shaft 225 and gear 224*d*. Gear 224*d* is configured to drive the driver gear 204. The gearing in the driver module 201' shown in FIG. 3B further comprises gear 224*e* and the driver gear 204' is positioned transverse relative to driver gear 204. It will be appreciated that any suitable form of motor 216, gear arrangement, and power module 205 may be employed. For example, the motor 216 may be powered by a power lead or by battery 218, such as by one or more AA batteries. The motor 216 may be any type of motor, and if a non-reversible motor is used, it may employ further gears and/or clutches in order to reverse direction of the driver gear 204 if desired. The gearing may be selected to achieve an optimum gear ratio for a desired speed of operation and a desired power source 205. For example, a higher gear ratio may be employed so that the styling module may be driven at a desired speed but powered by a smaller power source 205 such as fewer or less powerful batteries. It will be understood that the size and method of operation of the battery 218 and/or motor 216 is not limited to the examples provided herein, and that any suitable power module 205 comprising a power source 217, battery 218, motor 216 or electrical generator may be used. In addition, in some arrangements, it may be desirable to power a hair styling module in-part or entirely manually. In various embodiments, the power module 205 comprises any electrical motor 216, including a reversible motor. The motor 216 may be driven by a power source 217 comprising any suitable power generator, including a battery 218 or a cord connection to a 120 volt or a 240 volt electrical outlet.

Figures 4A, 4B:
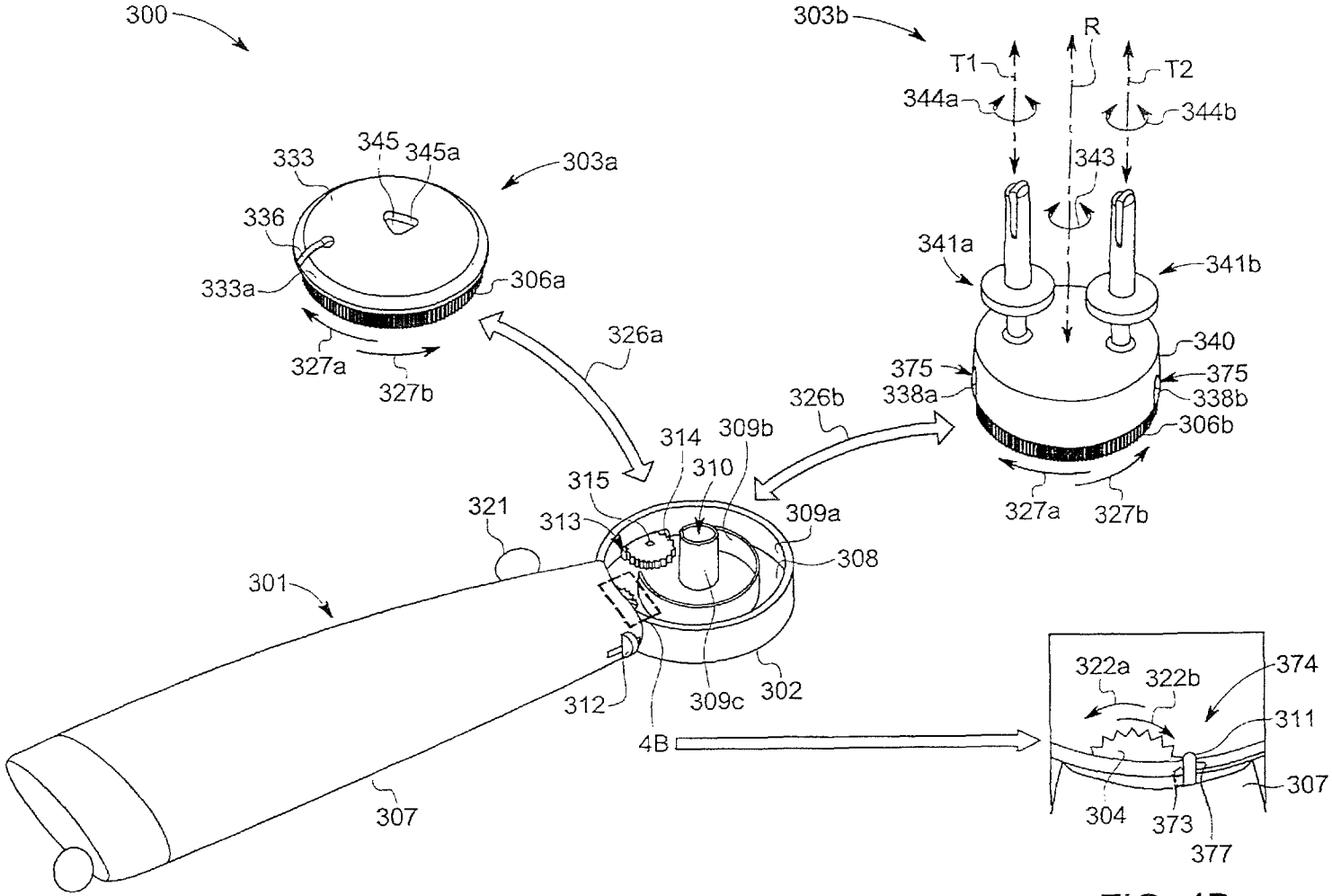
FIG. 4A illustrates a hair styling system and apparatus comprising modular hair styling modules according to various embodiments described herein.
FIG. 4B is a magnified view of box 4B of FIG. 4A illustrating a driver gear and tab of the driver module according to various embodiments described herein.

FIG. 4A illustrates the general versatility of the hair styling system 300 and apparatus comprising modular devices according to various embodiments. In this example, a hair styling system 300 and apparatus is shown comprising various modular devices including a driver module 301 and at least a first styling module 303*a* and a second styling module 303*b*. FIG. 4B illustrates a magnified view of the portion of the driver module 301 indicated by box 4B in FIG. 4A and is referred to by reference in FIGS. 5A and 6A. The driver module 301 may be similar to the driver module 101, 201 described above, with similar features being similarly identified. Additional details regarding certain specific embodiments of the two exemplary styling modules 303*a*, 303*b* are provided with respect to FIGS. 5A-10. However, various aspects of the operation and interrelationships of the system 300 and the modular devices 301, 303*a*, 303*b* of the apparatus are initially presented here, with reference to certain features more clearly shown in FIGS. 5A-10, to provide a better understanding of the invention.

The driver module 301 includes a holder 302 configured to interchangeably receive 326*a*, 326*b* at least a first styling module 303*a* and a second styling module 303*b*, each configured to perform at least one styling operation. Embodiments of the first and second styling modules 303*a*, 303*b* upon being received by the holder 302 are depicted in FIGS. 5B, 6B, & 6C. The driver module 301 further comprises a driver gear 304 positioned adjacent to the holder 302 and a power module comprising a motor configured to drive the driver gear 304 in a first direction 322*a* and a second direction 322*b*. The first and second interchangeably receivable styling modules 303*a*, 303*b* each comprise a styling module gear

306*a*, 306*b* configured to operatively engage the driver gear 304 and are rotatable thereby to perform at least one styling operation distinguishable from at least one other styling module 303*a*, 303*b*. For example, the styling module gears 306*a*, 306*b* are configured to be driven to rotate in a third direction 327*a* when the driver gear 304 is driven in the first direction 322*a* and in a fourth direction 327*b* when the driver gear 304 is driven in the second direction 322*b*. The first styling module 303*a* comprises the first styling module gear 306*a* and is configured to perform a first styling operation 328 when the first styling module gear 306*a* is rotated in at least one of the third direction 327*a* and the fourth direction 327*b*. The second styling module 303*b* comprises the second styling module gear 306*b* and is configured to perform a second styling operation 329 when the second styling module gear 306*b* is rotated in the third direction 327*a* and a third styling operation 331 when the second styling module gear 306*b* is driven in the fourth direction 327*b*.

As stated above, in various embodiments, the styling system 300 and apparatus is configured for interchanging styling modules 303*a*, 303*b* to perform separate or distinct styling operations with each styling module 303*a*, 303*b*. In one embodiment, at least one styling module 303*a*, 303*b* is configured to perform at least two separate or distinct styling operations. For example, as shown in FIG. 5B, and as described in more detail with respect to that figure, the first styling module 303*a* is configured to perform a first styling operation 328 comprising wrapping a lock of hair 337 with a cord 335 when the first styling module gear 306*a* is rotated in at least one of the third direction 327*a* and the fourth direction 327*b*. While FIG. 5B depicts the first styling operation 328 when the first styling module gear 306*a* is rotated in the third direction 327*a*, in various embodiments, the first styling module 303*a* may perform the first styling operation 328 to wrap or unwrap hair 337 when the first styling module gear 306*a* is rotated in the fourth direction 327*b*. As shown in FIG. 6C, and as described in more detail with respect to that figure, the second styling operation 329 comprises twisting at least two separate locks of hair 330*a*, 330*b* when the second styling module gear 306*b* is rotated in the third direction 327*a* and the third styling operation 331 331 comprises twining at least two separate locks of hair 332*a*, 332*b*, which may be the same or different than locks 330*a*, 330*b*, together when the second styling module gear 306*b* is rotated in the fourth direction 327*b*.

Still referring to FIGS. 4A & 4B, with reference to FIGS. 5A-7, the first styling module 303*a* comprises a rotation body 333 rotationally coupled to the first styling module gear 306*a* and a spool 334 (see FIG. 5A) rotatably mounted with respect to the first styling module gear 306*a* and rotation body 333. The spool 334 may be configured to retain a length of cord 335 (see FIG. 5A) configured to be dispensed or let out from the spool 334 when the spool 334 rotates relative to the rotation body 333. The rotation body 333 defines a lip 333*a* about its circumference configured to be opposed by the tab 311 when the first styling module is received by the holder 302. The rotation body also defines a groove 336 configured for threadably extending the cord 335 through a portion of the rotation body 333 such that rotation of the rotation body 333 rotates the cord 335 with the rotation of the rotation body 333 to wrap the cord 335 about a lock of hair 337 (see FIG. 5B).

Figure 6B:
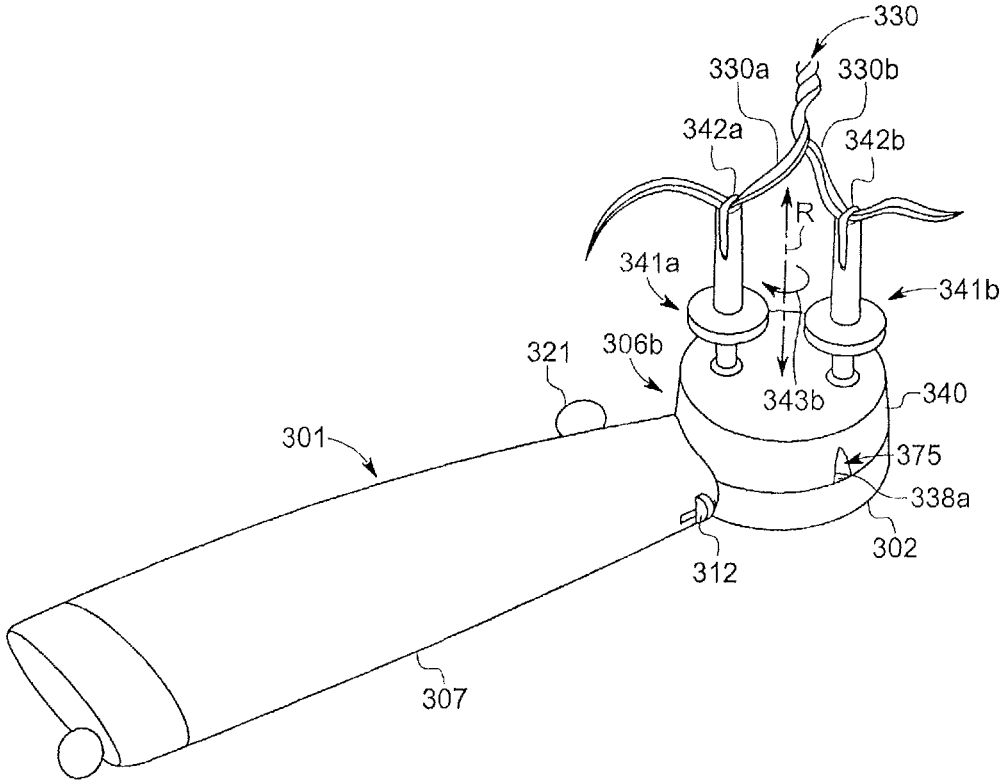
FIG. 6B illustrates the second styling module coupled to the driver module of FIG. 6A performing another styling operation according to various embodiments described herein.
Figure 6C:
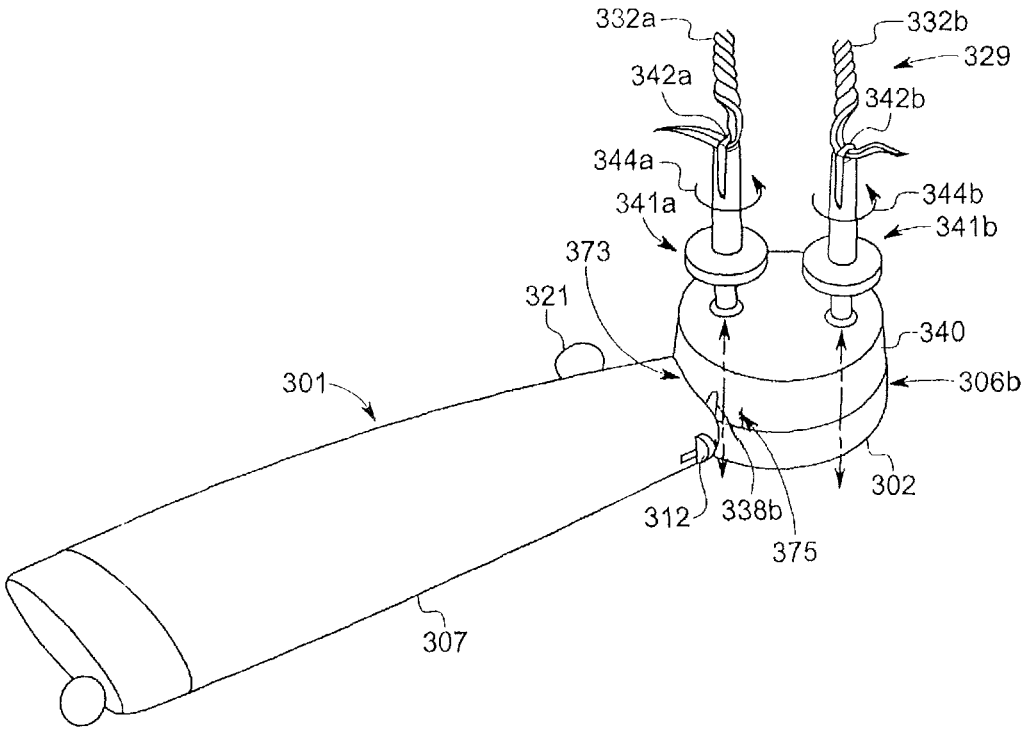
FIG. 6C illustrates the second styling module coupled to the driver module of FIG. 6A performing yet another styling operation according to various embodiments described herein.
Figure 7:
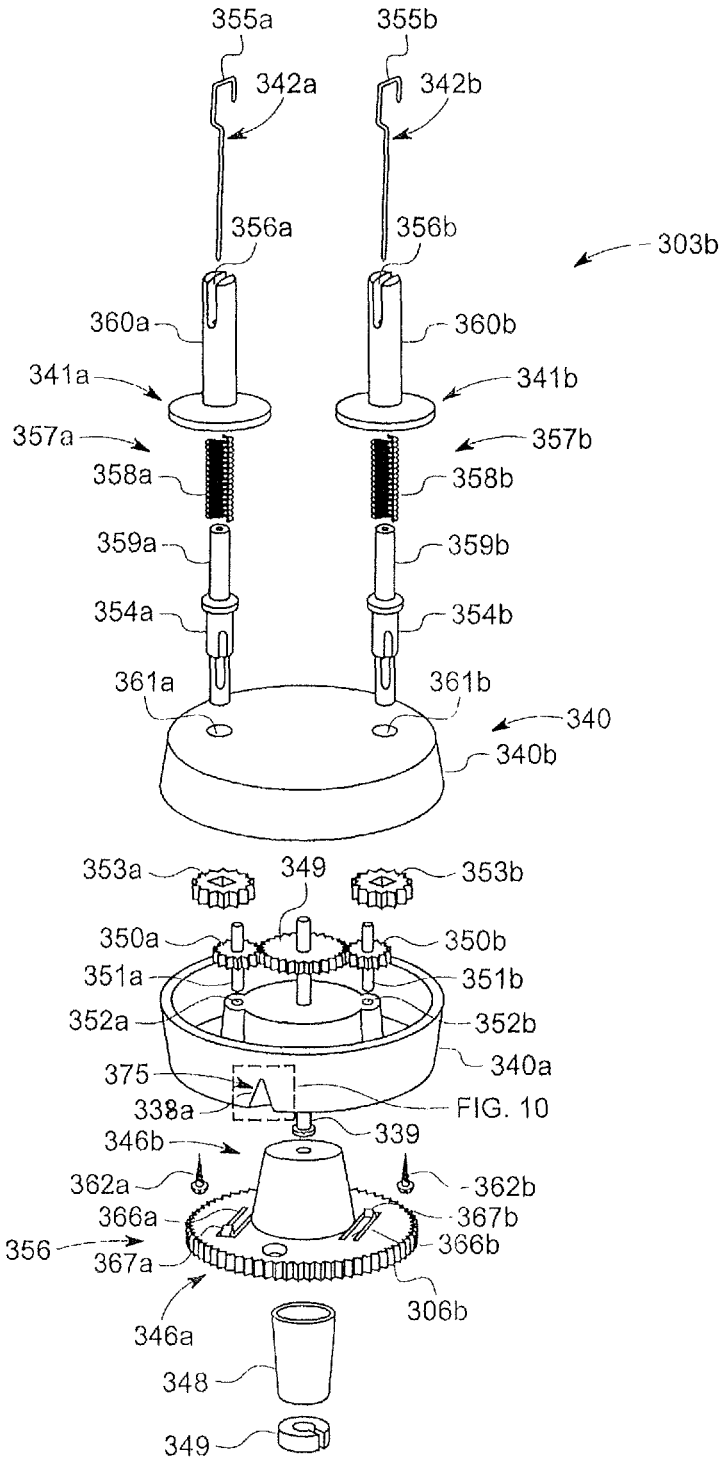
FIG. 7 illustrates an exploded view of the second styling module of according to various embodiments described herein.

The second styling module 303*b* comprises the second styling module gear 306*b*, which is rotationally coupled to a shaft 339 (see FIG. 7). The second styling module gear 306*b* is configured to operably engage the driver gear 304 when the second styling module 303*b* is received by the holder 302. The second styling module gear 306*b* is configured to rotate in the third direction 327*a* relative to the holder 302 when the driver gear 304 is driven in the first direction 322*a* and in a fourth direction 327*b* relative to the holder 302 when the driver gear 304 is driven in the second direction 322*b*. The second styling module 303*b* further comprises a rotation body 340 rotatable 343 about axis R. The rotation body 340 is rotatably coupled to the second styling module gear 306*b* and shaft 339. The rotation body 340 defines one or more stops 338*a*, 338*b* comprising a notch or groove for engagement with the tab 311 to maintain the position of the rotation body 340 with the holder 302 when the second styling module gear 304*b* is rotated in the third direction 327*a*, e.g., to prevent coupled rotation between the second styling module gear 306*b* and the rotation body 340 when the rotation body 340 attempts to rotate in a fifth direction 343*a* and to allow the rotation body 340 to rotate in a sixth direction 343*b* coupled with the rotation of the styling module gear 306*b* in fourth direction 327*b*. The second styling module 303*b* further includes at least a first twist assembly 341*a* and a second twist assembly 341*b* each comprising a grabber 342*a*, 342*b* configured to grab one or more locks of hair. The first and second twist assemblies 341*a*, 341*b* are rotatable 344*a*, 344*b* about a respective first and second twist axis T1, T2 via the shaft 339 when the second styling module gear 306*b* and the shaft 339 rotate relative to the rotation body 340 to perform the second styling operation 329 (see FIG. 6C). It is to be appreciated that the direction of rotation 343*a*, 342*b* of the twist assemblies 341*a*, 341*b* may be the same or different. The first and second twist assemblies 341*a*, 341*b* may further be rotationally coupled to the rotation 343 of the rotation body 340 to co-rotate about a third axis R when the rotation body 340 rotates relative to the holder 302 to perform the third styling operation 331 (see FIG. 6B).

Figure 5A:
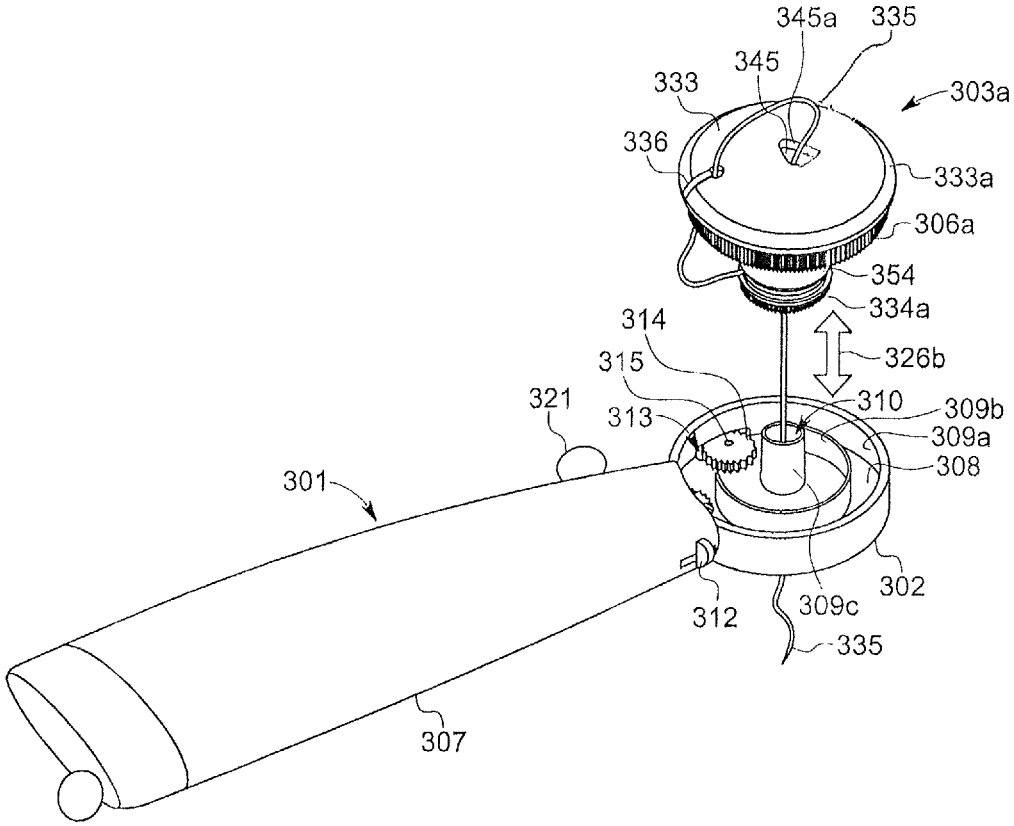
FIG. 5A illustrates coupling of a first styling module to the driver module of FIG. 2A according to various embodiments described herein.
Figure 5B:
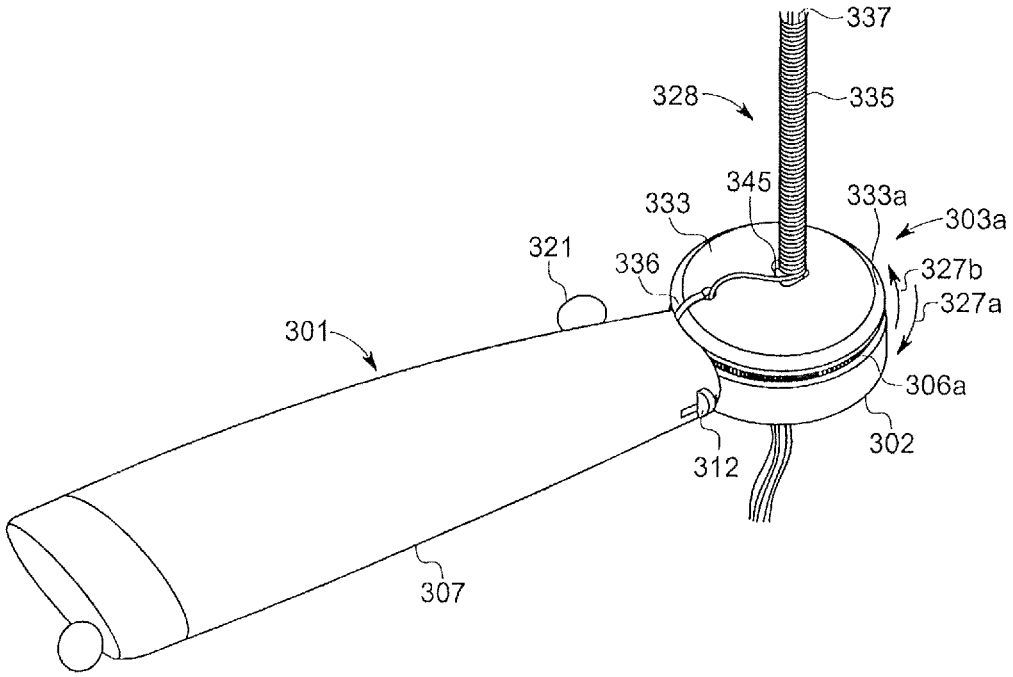
FIG. 5B illustrates the first styling module coupled to the driver module of FIG. 5A performing a styling operation according to various embodiments described herein.

FIG. 5A illustrates the first styling module 303*a* for selective coupling 326*a* to the driver module 30. FIG. 5B further depicts the first styling module 303*a* interchangeably coupled to the holder 302 and performing the first styling operation 328 comprising wrapping a lock of hair 337 with a cord 335 according to various embodiments described herein. The first styling module 303*a* is configured for selective coupling 326*a* to the driver module 301, e.g., attachment and detachment with respect to the holder 304. In various embodiments, the first styling module 303*a* may be similar to the wrapper described in U.S. Pat. No. 6,637,441, which is herein incorporated by reference specifically with respect to the wrapper.

The first styling module 303*a* includes a rotation body 333. The rotation body 333 includes a first end and a second end. The first styling module gear 306*a* is positioned at the first end and an aperture 345 is defined between the first end and the second end. The aperture 345 may be at least partially defined by a central tube that extends to a base of the rotation body 333. The rotation body 333 may further include a circumferential surface defining a lip 333*a* positioned therearound. When the first styling module 303*a* is received by the holder 302, the central tube may receive the wall 309*c* or sleeve of the holder 302. The tab 311 may be configured to be positioned at a surface of the lip 333*a* adjacent to the second end to retain the first styling module 303*a*. Actuating the actuator 312 is operably coupled to the tab 311 to retract the tab 311 and allow decoupling of the first styling module 303*a* from the holder 302. The first styling module gear 306*a* is configured to engage and be driven by the driver gear 304 described above.

In various embodiments, the central aperture 345 defined at the second end of the rotation body 333 may be of a generally triangular or any other suitable shape. The remainder of the central aperture 345 may have the same or a different shape.

A portion of the central aperture 345 may be offset or off-center with respect to the remainder of the central tube. The central aperture 345 may also include a rounded apex 345*a* located at the center of the aperture 345 and the remainder of the triangular aperture 345 may be disposed off-center. The apex 345*a* can have a radius approximately equal to that of the lock of hair 337 that is to be wrapped. The aperture 345 may have an off-center area through which hair may be inserted or threaded, and can have a smaller area, preferably located in a substantially central portion in which the hair may be tightly held during the first styling operation 329 comprising a wrapping operation. Any suitable shape of aperture 345 may be used. For example, the aperture 345 may have a triangular, tapered, keyhole, diamond or fusiform shape, amongst others. A slot 336 may be located in the circumferential wall of the rotation body 333 opposite to apex 345*a* of the central aperture 345. A sleeve or central tube may extending from the second end around the aperture 345 to the first end of the rotation body 333.

The spool 334 may be provided on which the cord 335 or thread having a free end can be spooled. The cord 335 may be any type of cord 335, and may be of any suitable material, such as cotton, silk, synthetic material, and wool. In one embodiment, the cord 335 is rigid and configured to not stretch in use, although in other embodiments the cord 335 comprises a an elastic material. The cord 335 may be of any suitable thickness, and need not have a circular cross-section. For example, the cord 335 may be a ribbon. The spool 334 includes a spooling surface about which cord 335 may be spooled. A spool gear 334*a* may be positioned at one end of the spool and configured to engage the thumb gear 314 for manual spooling and effectuating cord 335 tensioning. The spool 334 may include a central tube portion defining a bore extending from the first end to the second end of the spool 334 and configured to receive the central tube extending from the second end to the to the first end of the rotation body 333. The second end of the spool 334 may comprise an outwardly extending lip about the outer circumference of the bore configured to assist in retaining the spool 334 on the central tube of the rotation body 333. For example, the rotation body 333 may comprise a complementary dimension or groove configured to receive the lip. The complementary dimension or groove may comprise a flexible or compressible material positioned at a reduced diameter with respect to the lip such that the lip may be inserted beyond the reduced diameter in a first direction and reasonably retained by the reduce diameter in a second direction to allow the spool 334 to be sufficiently retained on the central tube such that the spool 334 does not fall off the first end of the central tube when first styling module 303*a* is held second end up. The spool 334 may be rotatably coupled or be configured for rotation relative to the rotation body 333 via rotation of the thumb gear 314, if present. As such, other retention arrangements may also be used such that the spool 334 is rotatable relative to the rotation body 333 when the bore receives the central tube of the rotation body 333. For example, an outwardly projecting chamfered lip can be provided around the top of the central tube. The first styling module 303*a* may also include a tensioner to apply tension to restrain rotation of the spool 334 or assist in retention of the spool 334 on the central tube.

To assemble the first styling module 303*a*, the spool 334 may be threaded with the cord 335 and positioned on the sleeve of the central tube, which may be received within the spool bore. A free end of the cord 335 may be drawn through the groove or slot 336 to rest on the top of the second end of the rotation body. The spool 334 may be free to rotate on the sleeve to enable the cord 335 to be easily unwound.

To couple the first styling module 303*a* to the driver module 301, the tab 311 of the housing 307 may be retracted using the actuator 312 or by compressing an inclined surface of the tab 311 with the lip 333*a* of the rotation body 333 to actuate the tab 311 when positioning the first styling module 333*a* in the holder 302. When the lip 333*a* of the rotation body 333 is placed into the holder 302, the first styling module gear 306*a* is locatable within the outer wall 309*c* for alignment with the driver gear 304. The sleeve of the rotation body 333 may be inserted over sleeve of the holder 302. The thumb gear 314 may also be aligned with the spool gear 334*a* and the tabbed latch may then be released to secure the first styling module 303*a* in place. The latch may be retracted to relocate the tab 311 away from the lip 333*a* of the rotation body 333 such that the first styling module 303*a* may be removed from the holder 302.

In one example, the user may slide the lever 321 forward to cause the motor to drive the driver gear 304 in the first direction 322*a*. In this example, the driver gear 304 interacts with the first styling module gear 306*a* to transmit rotation of the driver gear 304 to the first styling module gear 306*a* to thereby rotate the rotation body 333. As the cord 335 is restrained by the groove or slot 336, the cord 335 is rotated with rotation of the rotation body 333, and pulls the cord 335 from the spool 334, thus rotating the spool 334 about the sleeve to dispense or let out the cord 335. In various embodiments, it does not matter if the cord 335 has been wound clockwise or counter-clockwise onto spool 334, as the spool 334 may rotate in either direction, independently of the direction of rotation of the rotation body 333. A tensioner or friction surface configured to retain the spool 334 on the sleeve, as described above may ensure that a consistent tension is maintained in the cord 335 during the rotation of spool 334. In various embodiments, due to the shape of the aperture 345 in rotation body 333, and because the groove or slot 336 is opposite to the apex 345*a* of the aperture 345. the tension in the cord 335 may pull the lock of hair into the apex 345*a* as the hair is wrapped. As a result, the lock of hair can be retained in a tight bundle having approximately the radius of the rounded apex 345*a*.

The user may also or in addition operate thumb gear 314 to manually rotate the spool 334 or finely adjust the wrapping operation by retracting the cord 335 to take up any slack in the cord 335. For example, after reversing the wrapping to remove a mistake, the user may tighten the cord 335 to the correct tension using thumb gear before continuing to wrap in the forwards direction.

In various embodiments, as shown in FIGS. 4A, 4B, 6A-10, the styling system 300 includes a second styling module comprising a twisting and cabling attachment configured for selective coupling to the driver module 301, e.g., for attachment and detachment 326*b* to the driver module 301 at the holder 302 and selectively operable thereon to perform the second and third styling operation 331s respectively comprising a twist and a cable operation, as shown in FIG. 6B. For example, when received by the holder 302, the second styling module 303*b* is configured for rotation 344*a* of the first twist assembly 341*a* about a first twist axis T1 to twist a first lock of hair 332*a* retained at the first grabber 342*a* and rotation 344*b* of the second twist assembly 341*b* about a second twist axis T2 to twist a second lock of hair 332*b* retained at the second grabber 342*b*. The rotation body 340 is further configured to rotate 343 about a third axis R to co-rotate both the first twist assembly 341*a* and the second twist assembly 341*b* about the third axis R to cable the first and second locks of hair. Preferably, the twist assemblies 341*a*, 341*b* may be rotated 344*a*, 344*b* about the first and second twist axes T1, T2 independent of the rotation 343 of the rotation body 340.

For example, the rotation of the first and second twist assemblies 341*a*, 341*b* on respective first and second twist axes T1, T2 is preferably decoupled from rotation of the rotation body 340 on the third axis R. The rotation 344*a*, 344*b* of the first and second twist assemblies 341*a*, 341*b* on respective first and second twist axes T1, T2 may preferably also be accomplished while the rotation body 340 is stationary and neither the first twist assembly nor the second twist assembly 341*a*, 341*b* is rotating about the third axis R. Thus, in one embodiment, the second styling module 303*b* is configured to operate in a first rotationally decoupled mode and second rotationally coupled mode. In the first rotationally decoupled mode, the first and second twist assemblies 341*a*, 341*b* rotate 344*a*, 344*b* relative to respective first and second twist axes T1, T2 but not with respect to the third axis R, and the rotation body 340 is substantially stationary with respect to the third axis R. In the second rotationally coupled mode, the rotation body 340 rotates 343 about the third axis R such that the rotation 343 is coupled to first and second twist assemblies 341*a*, 341*b* to rotate the first and second twist assembles 341*a*, 341*b* about the third axis R. The first and second twist assemblies 341*a*, 341*b* preferably do not rotate on respective first and second twist axes T1, T2 in the coupled mode. In certain embodiments, the various rotations of the second styling module 303*b* are configured to be driven by the rotation of the driver gear 304 which transmits rotation directly to the second styling module gear 306*b* in both the coupled and decoupled modes. Thus, rotation of the twist assemblies 341*a*, 341*b* and rotation body 340 on or about the first twist axis T1, the second twist axis T2, or third axis R, whether coupled or decoupled, may ultimately be traceable to a single gear 306*a* of the second styling module 303*b* driven by the driver gear 304.

Figure 6A:
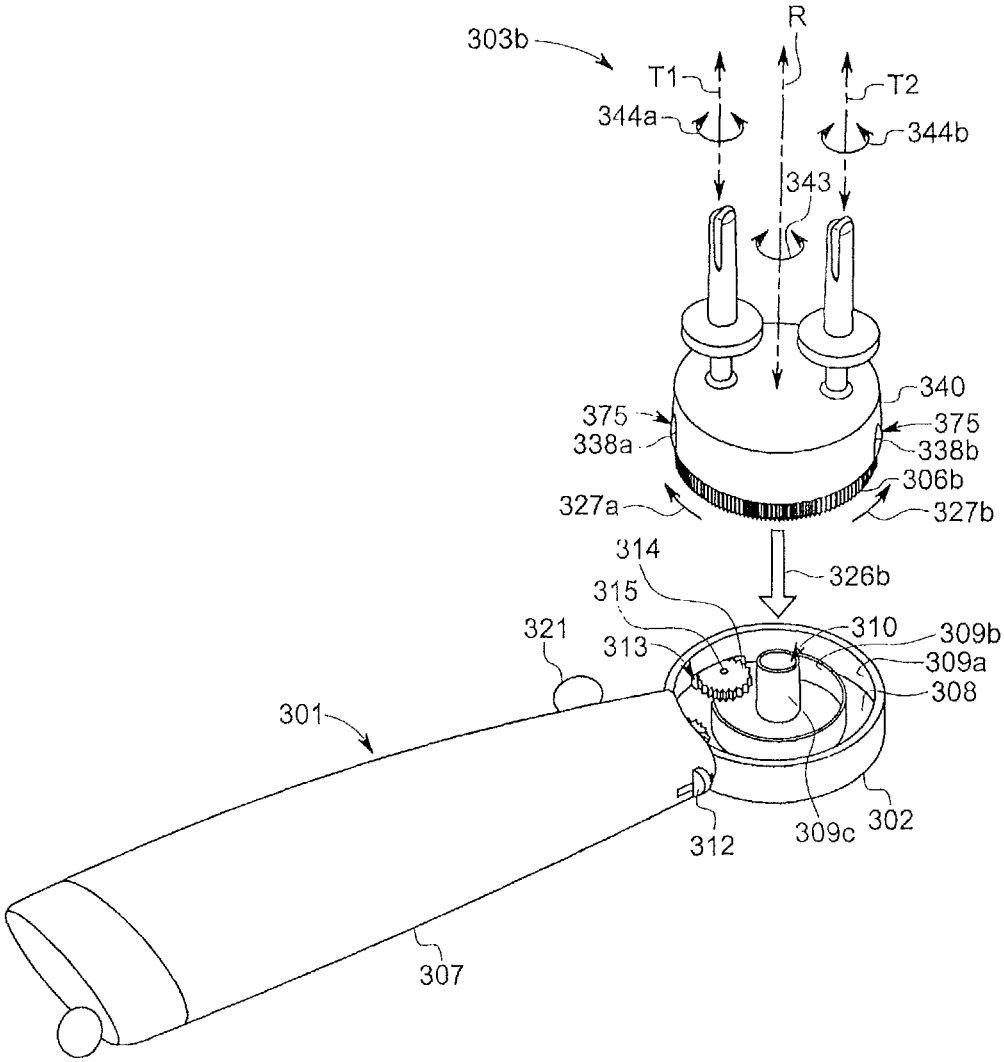
FIG. 6A illustrates coupling of a second styling module with the driver module of FIG. 2A according to various embodiments described herein.

Still referring to FIGS. 6A & 6B and FIG. 7, which illustrates an exploded view of the second styling module 303*b* configured for selective coupling to the driver module 301 according to various embodiments described herein. As introduced above, the second styling module 303*b* includes a second styling module gear 306*b*. A shaft 339 extends from a first end 346*a* to a second end 346*b* of the second styling module gear 306*b* and is rotationally coupled thereto. The second styling module gear 306*b* is rotatable in the third direction 327*a* when the drive gear 304 is rotated in the first direction 322*a* and rotatable in the fourth direction 327*b* when the drive gear 304 is rotated in the second direction 322*b*. The shaft 339 further extends through a cylindrical spacer 347 and retainer 348 positioned at the first end 346*a* to space the second styling module gear 306*b* relative to the holder 302 and driver gear 304. The retainer 348 and spacer 448 are dimensioned to be received within the central aperture 310 of the holder 302. In some embodiments, the retainer 348 may be configured for a friction or compression fit with the wall 309*c* defining the central aperture 310. The shaft 339 further extends from the second end 346*b* through the rotation body 340 (illustrated as including a first rotation body portion 340*a* and a second rotation body portion 340*b* in FIG. 7) and is rotationally coupled to the a twist gear 349. The twist gear 349 is mounted on the shaft 339 and is configured to drivably engage a first idler gear 350*a* and a second idler gear 350*a*. Each idler gear 350*a*, 350*b* may be connected to an idler gear shaft 351*a*, 351*b*. A portion of the idler gear shafts 351*a*, 351*b* may reside within recesses 352*a*, 352*b* in an inner wall of the rotation body 340. However, other positioning may be used. When the twist gear 349 is driven by the shaft 339 to drive the first and second idler gears 350*a*, 350*b*, the first and second idler gears 350*a*, 350*b* are configured to respectively rotate first and second grabber gears 353*a*, 353*b*. The first and second grabber gears 353*a*, 353*b* are rotationally coupled with respective first and second twist assemblies 341*a*, 341*b* via drive posts 354*a*, 354*b*.

While the second styling module 303*b* may comprise more than two twist assemblies 341*a*, 341*b*, only two twist assemblies 341*a*, 341*b* are illustrated for clarity. Each twist assembly 341*a*, 341*b* may comprise a grabber 342*a*, 342*b* configured to grab a lock of hair 332*a*, 332*b* for rotation 344*a*, 344*b* about its respective axis T1, T2 to perform a twist styling operation. The grabbers 342*a*, 342*b* may include a hook 355*a*, 355*b* configured to hook the locks of hair 332*a*, 332*b*, however, in other embodiments, the first and second grabbers 342*a*, 342*b* may include additional configurations configured to capture or bunch hair such as a loop, clip, fastener, or clasp. In various embodiments, grabbers 342*a*, 342*b* may be retractable or extendable to increase ability to grab the locks hair 332*a*, 332*h*. The twist assemblies 341*a*, 341*b* may each include a grabber 342*a*, 342*b* configured to extend from a slot 356*a*, 356*b* to engage or disengage hair and retract toward the slot 356*a*, 356*b* to retain the engaged hair at its respective twist assembly 341*a*, 341*b*. For example, grabbers 342*a*, 342*b* may be translatable between an extended release position and a retracted grab position. As illustrated, the twist assemblies 341*a*, 341*b* further include retractors 357*a*, 357*b*. Retractors 357*a*, 357*b* can be used to move the grabbers 342*a*, 342*b* between the release position and the grabbing position. The retractors 357*a*, 357*b* may be any structure suitable for moving the grabbers 342*a*, 342*b* but preferably include springs 358*a*, 358*b*. Each retractor includes a spring 358*a*, 358*b* compressably mounted over a guide portion 359*a*, 359*b* of a drive post 354*a*, 354*b* rotationally coupled to the grabber gear 353*a*, 353*b* and the grabber 342*a*, 342*b*. A sleeve 360*a*, 360*b* comprising a central bore is positioned over the spring 358*a*, 358*b* and guide 359*a*, 359*b*. The spring 358*a*, 358*b* is configured to bias the sleeve 360*a*, 360*b* outward of the rotation body 340. The central bore of the sleeve 360*a*, 360*b* includes a reduced diameter configured to engage a lip of the drive post 354*a*, 354*b* to limit the outward translation of the sleeve 360*a*, 360*b*. The sleeve 360*a*, 360*b* may further include the slot 356*a*, 356*b* configured to receive the grabber 342*a*, 342*b*. To transition the grabber 342*a*, 342*b* from a retracted grab position within the slot 355*a*, 355*b* to an extended release or engagement position, a compression force may be applied to the sleeve 360*a*, 360*b* to compress the spring 358*a*, 358*b* and translate the sleeve 360*a*, 360*b* toward the second portion rotation body portion 340*b* such that the spring 358*a*, 358*b* compresses and the grabber 342*a*, 342*b* is exposed from the slot 356*a*, 356*b*. Removal of the compression force from the sleeves 360*a*, 360*b* allows the springs 358*a*, 358*b* to bias the sleeve 360*a*, 360*b* outwardly of the second rotation body portion 340*b* to retract the grabbers 342*a*, 342*b* into the slots 356*a*, 356*b* and transition the grabbers 342*a*, 342*b* from the release position to the grabbing position The twist assemblies 341*a*, 341*b* extend from apertures 361*a*, 361*b* defined in the second rotation body portion 340*b* configured to receive and retain a respective twist assembly 341*a*, 341*b* and are rotationally coupled to the rotation body 340 about the third axis R. Each of the twist assemblies 341*a*, 341*b* is rotatable 344 within its respective aperture 361*a*, 361*b*. While the illustrated embodiment depicts the rotation body 340 as having a first end comprising the lower first body portion 340*a* and a the upper second body portion 340*b*, in various embodiments, the rotation body 340 may include additional body portions for ease of manufacture or adjustment or a single body unit. The first and second rotation body portions 340*a*, 340*b* may be attached in any manner. As shown, screws 362*a*, 362*b* are provided to attach first and second rotation body portions 340*a*, 340*b*. The rotation body 340 is configured for rotation about the third axis R, which may be the same as a rotation axis of the second styling module gear 306*b*, generally along the shaft 339.

As described above, in one embodiment, the twist assemblies 341*a*, 341*b* are rotatable 344*a*, 344*b* about their respective axes T1, T2 independent of the rotation 343 of the rotation body 340. When the twist assemblies 341*a*, 341*b* rotate 344*a*, 344*b* about on their respective axes T1, T2, the styling module is configured to isolate the rotation 344*a*, 344*b* such that the rotation body 340 remains substantially stationary with respect to the third axis R. That is, the twist assemblies 341*a*, 341*b* are configured to rotate 344*a*, 344*b* or be rotatable relative to the rotation body 340. For example, one or more clutches or stoppers may be utilized to decouple rotation or prevent rotation of the rotation body 340 when the twist assemblies 341*a*, 341*b* rotate 344*a*. 344*b* about their respective axis. The second styling module 303*b* is further configured to allow selective rotation 343 of the rotation body 340 on the third axis R and further coupling of that rotation to co-rotate the twist assemblies 341*a*, 341*b* about the third axis R of the rotation body 340. When the rotation body 340 rotates 343 on the third axis R, the twist assemblies 341*a*, 341*b* are coupled to such rotation 343 to rotate about the third axis R. The twist assemblies 341*a*, 341*b* however may also be configured to remain substantially stationary with respect to their respective axes T1, T2 and the rotation body 340 while rotating 343 about the third axis R occurs. The rotation 343 of the rotation body 340 about the third axis R, the rotation 344*a*, 344*b* of the twisting assemblies about their respective axes T1, T2, and the rotation 343 of the twist assemblies 341*a*, 341*b* about the third axis R may be driven by the same driver gear 304 via the engagement of the driver gear 304 with the second styling module gear 306*b*. In some embodiments, the twist assemblies 341*a*, 341*b* are configured to rotate 344*a*, 344*b* on their respective axes T1, T2 when the second styling module gear 306*b* is rotated in the third direction 327*a*. The rotation body 340 may therefore be configured to remain substantially stationary with respect to the third axis R when the twist assemblies 341*a*, 341*b* rotate 344*a*, 344*b* on their respective axes T1, T2. In one such embodiment, the rotation body 340 is rotationally coupled to the second styling module gear 306*b* when the second styling module gear 306*b* is rotated in the fourth direction 327*b* such that both the rotation body 340 and the second styling module gear 306*b* rotate together in at least one direction. In another configuration, the second styling module gear 306*b* may couple to another gear configured to rotate 343 the rotation body 340 in a different direction when the second styling module gear 306*b* is rotated in the fourth direction 327*b*. In either event, when the second styling module gear 306*b* rotates in the fourth direction 327*b*, the rotation body 340 is configured to rotate 343 to co-rotate the twist assemblies 341*a*, 341*b* with respect to the third axis R. The twist assemblies 341*a*, 341*b* preferably remain substantially stationary relative to the rotation body 340 when the rotation body 340 rotates 343. Accordingly, when the second styling module gear 306*b* rotates in the second direction 322*b*, the rotation body 340 and the twist assemblies 341*a*, 341*b* are configured to have coupled rotation 343 about the third axis R but the twist assemblies 341*a*, 341*b* do not rotate relative to the rotation body 340.

In various embodiments, the second styling module 303*b* comprises one or more clutch assemblies or clutch assembly components configured to cooperatively associate with clutch assembly components of the driver module 301 when received by the holder 302. Clutch assemblies may be configured to couple or decouple rotations of the second styling module 303*b*. Accordingly, in some instances, the clutch assemblies may be referred to as couplers or decouplers. In certain embodiments, any clutch configuration suitable to couple and decouple rotation may be used. It is to be appreciated that rotations may be coupled at different rates of rotation. Similarly, in some embodiments, coupled rotations may include transferred or redirected rotation that nonetheless are rotationally linked. In one embodiment, the second styling module gear 306*b* or rotation body 340 includes an extension or engagement member configured to engage, e.g., compressible, frictional, mechanical, etc., the other to couple rotation. In one embodiment, the second styling module 303*b* includes a clutch assembly comprising a biasing member, such as a spring, elastic, resilient, or compressible arm or material structured to bias an engagement portion of a clutch arm against an adjacent surface, e.g., a surface of the second styling module gear 306*b* or rotation body 340. In one embodiment, a clutch assembly is configured to be engaged to couple rotation or disengaged to decouple rotation. A clutch assembly may also be configured to be engaged to decouple rotation. For example, when the second styling module gear 306*b* and rotation body 340 include coupled rotation, e.g., include biased or engaged surfaces or couplings that at least partially frictionally or mechanically couple a rotation of the second styling module gear 306*b* and rotation body 340, a clutch assembly may be engaged for countering the bias or friction to decouple rotation.

In some embodiments, the one or more clutch assemblies comprise a coupling module configured to couple rotation of the second styling module gear 306*b* and the rotation body 340. In one embodiment, the coupling module comprises an arm or pin including an engagement portion configured for physical or mechanical engagement with an adjacent surface to couple the rotation of the second styling module gear 306*b* and rotation body 340. For example, the coupling module may include a clutch arm biased toward or selectively engageable to couple rotation. The coupling module may be unbiased or counter biased to disengage the clutch arm and decouple rotation. In one configuration, the driver module 301 includes an actuator to operatively manipulate engagement or disengagement of a clutch arm. The coupling module may include a biasing mechanism to bias engagement or disengagement of the second styling module gear 306*b* or rotation body 340, such as a pin, arm, or spring. In one embodiment, the coupling module comprises a selectively movable clutch arm that may be retracted or extended to engage or disengage the second styling module gear 306*b* and rotation body 340 to couple or decouple rotation. For example, the clutch arm may comprise a pin that is rotationally coupled to the second styling module gear 306*b* and that is selectively extendable to engage a surface or groove defined in or associated with of the rotation body 340 to couple rotation or retracted from such engagement to decouple rotation.

In various embodiments, the clutch assemblies are configured for directional engagement and disengagement to couple and decouple rotations. For example, in one embodiment, when the second styling module is received by the holder, a clutch assembly is configured to decouple rotation of the second styling module gear 306*b* and the shaft 339 from the rotation body 340 when the second styling module gear 306*b* is rotated in the third direction 327*a* to perform the second styling operation 329 and couple rotation of the second styling module gear 306*b*, the shaft 339, and the rotation body 340 when the second styling module gear 306*b* is rotated in the fourth direction 327*b* to perform the third styling operation 331. A directional clutch assembly may also be configured to engage and disengage with respect to a direction of rotation of the second styling module gear 306*b*. In one embodiment, a directional clutch assembly is configured for engagement when the second styling module gear 306*b* is rotated in a third direction 327*a* to allow relative rotation between the second styling module gear 306*b* and the rotation body 340 and disengagement when the second styling module gear 306*b* is rotated in a fourth direction to couple rotation of the second styling module gear 306*b* and the rotation body 340.

In one embodiment, the one or more clutch assemblies comprise a coupling module 365 comprising one or more clutch arms 366. The clutch arms 366*a*, 366*b* may include extensions biased toward an adjacent surface and have engagement portions 367*a*, 367*b* dimensioned to compress the adjacent surface to couple rotation of the second styling module gear 306*b* and rotation body 340. While either the second styling module gear 306*b*, the rotation body 340, or both may include clutch arms 366*a*, 366*b*, in the illustrated embodiment in FIG. 7, the second styling module gear 306*b* includes clutch arms 366*a*, 366*b* associated therewith. The clutch arms 366*a*, 366*b* comprise biased extensions extending to engagement portions 367*a*, 367*b* configured to engage a surface of the rotation body 340 comprising stops (not visible).

Figure 8A:
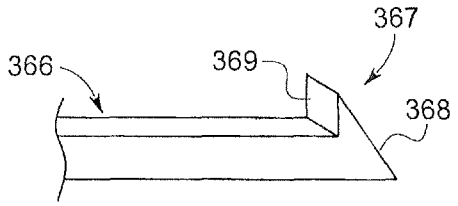
FIG. 8A illustrates a clutch arm configuration for use with a clutch assembly according to various embodiments described herein.
Figure 8B:
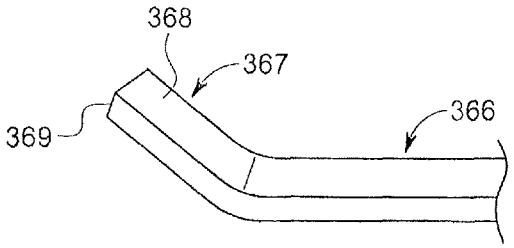
FIG. 8B illustrates a clutch arm configuration for use with a clutch assembly according to various embodiments described herein.
Figure 8C:
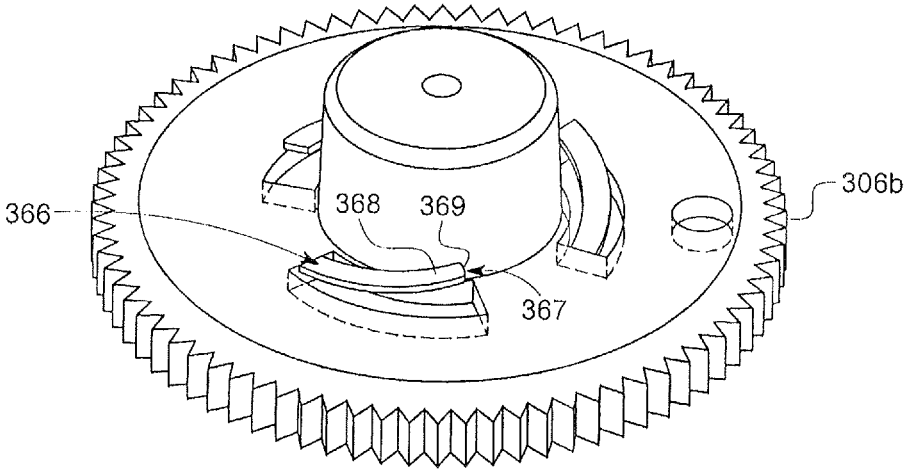
FIG. 8C illustrates an arrangement of clutch arms for use in a clutch assembly according to various embodiments described herein.
Figure 9A:
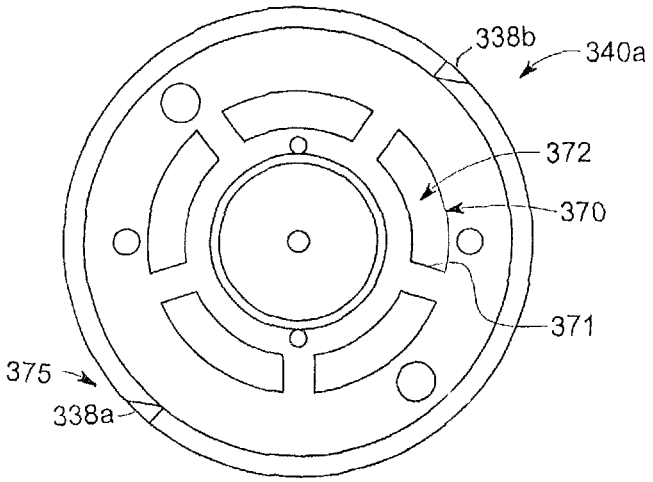
FIG. 9A illustrates a stop configuration for use with a clutch assembly according to various embodiments described herein.
Figure 9B:
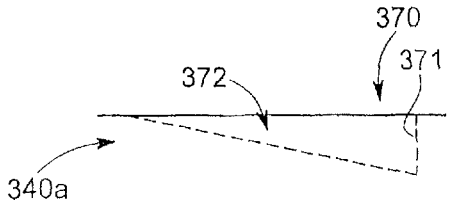
FIG. 9B illustrates a radial view of the stop configuration shown in FIG. 9A according to various embodiments described herein.

FIGS. 8A & 8B illustrates isolated views of various embodiments of clutch arms 366. FIG. 8C illustrates an arrangement of clutch arms 366 position about the second styling module gear 306*b* wherein the clutch arms 366 are dimensioned similar to the clutch arm 366 illustrated in FIG. 8B. FIGS. 9A & 9B illustrates stops 370 according to various embodiments of coupling modules 365. FIG. 9A is an axial bottom view of the first portion of the rotation body 340*a*, and FIG. 9B is a partially transparent radial view. The clutch arms 366 include engagement portions 367 comprising a first surface 368 and a second surface 369. The first surface 368 is configured to allow decoupled rotation and includes an angled portion configured to slip past stops 370 associated with the first rotation body portion 340*a* when directed, e.g., via rotation, in the third direction 327*a*. The second surface 369 includes an angled portion configured to engage the stops 370 associated with the first portion of the rotation body 340*b* when directed, e.g., via rotation, in the fourth direction 327*b* to couple rotation of the second styling module gear 306*b* and the rotation body 340. The angled portion of the second surface 369 is positioned to oppose, e.g., includes a generally perpendicular surface, to the fourth direction 327*b* or an abutment surface of a stop 370 and comprises a leading edge of the engagement portion 367 when the second styling module gear 306*b* is rotated in the fourth direction 327*b*.

In various embodiments, the styling module comprises a coupling module 365 configured to engage to couple rotation of the rotation body 340 and the second styling module gear 306*b* when the second styling module gear 306*b* is rotated in the fourth direction 327*b* and to disengage to allow decoupled rotation of the second styling module gear 306*b* relative to the rotation body 340 when the second styling module gear 306*b* is rotated in the third direction 327*a*. Thus, when the styling module is received by the holder 302 of the driver module 301 of the styling system 300, the coupling module 365 is configured to couple rotation of the second styling module gear 306*b* and the rotation body 340 when the second styling module gear 306*b* is rotated in the third direction 327*a* via rotation of the driver gear 304 in the first direction 322*a*. In various embodiments, the coupling module 365 comprises at least one clutch arm 366 extending between the second styling module gear 306*b* and the rotation body 340 and at least one stop 370 comprising an abutment surface 371 configured to engage the at least one clutch arm 366 when the second styling module gear 306*b* is rotated in the fourth direction 327*b* to couple the rotation of the second styling module gear 306*b* with the rotation body 340. In some embodiments, the at least one clutch arm 366 and the at least one stop 370 are dimensioned for passage of the at least one clutch arm 366 with respect to the at least one stop 370 when the second styling module gear 306*b* is rotated in the third direction 327*a* to allow decoupled rotation of the second styling module gear 306*b* and the rotation body 340. In one embodiment, the at least one stop 370 comprises a groove 372 formed on a surface of the rotation body 340 and comprises a progressively increased depth extending to the abutment surface 371. In various embodiments, the at least one stop 370 comprises arcuate grooves 372 positioned around the rotation body 340 as shown in FIG. 9A. Six stops 370 comprising grooves 372 are show in FIG. 9A, however, fewer or additional stops 370 or grooves 372 may be used. The number of stops 370 grooves 372 may be the same or different from the number of clutch arms 366. In some embodiments, the stop 370 may comprise an aperture wherein the clutch arm 366 is passable in one direction when contacting edges or abutment surface of the aperture and stably engageable in the other direction when contacting the edges or abutment surface 371 of the aperture. The at least one clutch arm 366 may be mounted on the second styling module gear 306*b* and be configured to be biased into the groove 372 to engage the abutment surface 371 when the second styling module gear 306*b* is rotated in the fourth direction 327*b* to couple rotation of the second styling module gear 306*b* with the rotation body 340. The at least one clutch arm 366 may then slide along the surface of the rotation body 340, over the abutment surface 371 of the stop, and through the groove 372 when the second styling module gear 306*b* is rotated in the third direction 327*a* relative to the rotation body 340. In operation, the at least one clutch arm 366 is configured to be disengaged to pass over the abutment surfaces 371 and allow relative rotation with respect to the rotation body 340 in the third direction 327*a* and to be engaged to coupled rotation with respect to the rotation body 340 when rotated in the fourth direction 327*b*, opposite of the third 327*b*. While the illustrated clutch arms 366 are configured to include flexible resilience or spring, in other embodiments, the rotation body 340 may include biased stops 370 or clutch arms 366 extending toward the second styling module gear 306*b* that may be counter biased away from the second styling module gear 306*b* by the clutch arms 366 or stops 370 positioned on the second styling module gear 306*b* when the second styling module gear 306*b* is rotated in the third direction 327*a* direction.

Figure 10:
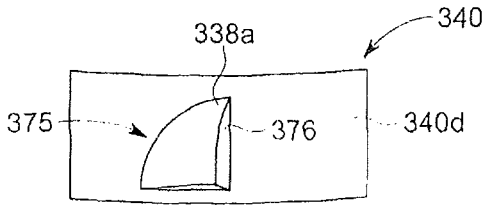
FIG. 10 illustrates stops formed on the outer surface of a rotation body for use with a clutch assembly according to various embodiments described herein.

In various embodiments, the styling system 300 and apparatus comprises a decoupling module 373, as generally indicated in FIG. 6C, configured to engage to decouple rotation of the second styling module gear 306*b* relative to the rotation body 340 when the second styling module gear 306*b* is rotated in the third direction 327*a* to perform the second styling operation and to disengage to allow coupled rotation of the second styling module gear 306*b* and rotation body 340 when the second styling module gear 306*b* is rotated in the fourth direction 327*b*. In one embodiment, the decoupling module 373 comprises structures of both the second styling module 303*b* and the driver module 301 that cooperatively associate to perform the decoupling module operations. For example, referring to FIGS. referring to FIGS. 4B, 7, & 10, when the second styling module 303*b* is received by the holder 302, the decoupling module 373 may comprise at least one clutch arm extending from the driver module 301 and including an engagement portion configured to engage at least one stop 375 defined on the rotation body 340. The at least one stop 375 may comprise grooves 338*a*, 338*b* extending to an abutment surface 376, as shown in FIG. 10 providing a magnified view of box 10 of FIG. 7, configured to cooperatively engage with the clutch arm 374 to oppose rotation of the rotation body 340 in a fifth direction 343*a* about the third axis R and relative to the holder 302 when the second styling module gear 306*b* is rotated in the third direction 327*a*. The at least one clutch arm 374 may be configured to pass over the groove 338*a*, 338*b* and engagement surface to allow rotation of the rotation body 340 relative to the holder 302 in a sixth direction 343*b* when the second styling module gear 306*b* is rotated in the fourth direction 327*b*. Other stop configurations may also be used, such as stops comprising extensions extending from the rotation body 340 that may be hooked or caught by the clutch arm 374 or a friction surface that may be frictionally engaged by a clutch arm 374.

As described above with respect to FIGS. 2A-5B, the driver module 301 comprises a latch comprising a tab 311 positioned adjacent to the holder 302 and configured to be biased toward a surface of a styling module received therein. The latch is operatively coupled to an actuator 312 configured to counter bias the tab 311 away from the surface of the styling module when actuated. When the holder 302 receives the first styling module 303*a* the tab 311 is configured to oppose a lip 333*a* defined on an outer surface of the first styling module 303*a* to latch or retain the first styling module 303*a* on the holder 302. As shown in the magnified views of FIGS. 4B & 10, and with reference to FIG. 6B, showing an assembled embodiment of the second styling module 303*b* received by the driver module 301, the tab 311 comprises a clutch arm 374 of the decoupling module 373 and thus the tab 311 of the driver module 301 may be multi-purposed depending on the styling module received by the holder 302. While only two decoupling module stops 375 are illustrated in the embodiments, in various embodiments, fewer or additional stops 375 may be provided. Similarly, additional clutch arms 374 may also be provided. In this embodiment, the groove 338*a*, 338*b* or notch defined on the outer surface of the rotation body 340 includes a groove 338*a*, 338*b* or notch. The stop 375 includes an abutment surface 376 configured to operably interface with a first surface 377 of an engagement portion of the clutch arm 374 to oppose rotation of the rotation body 340 when the second styling module gear 306*b* rotates in the third direction 327*a* to decouple rotation of the rotation body 340 from the rotation of the second styling module gear 306*b*. Thus, the decoupling module 373 may be configured to prevent coupled rotation of the rotation body 340 with the second styling module gear 306*b*, e.g., due to residual or component frictions, to maintain the rotation body 340 in a substantially stationary position when with second styling module gear 306*b* rotates in the third direction 327*a* or the twist assemblies 341*a*, 341*b* rotate 344*a*, 344*b* on their axes, e.g., when rotated by the rotation or the drive post 354*a*, 354*b*, the grabber gears 353*a*, 353*b*, and the idler gears 350*a*, 350*b*. In various embodiments, either the stop 375, clutch arm 374, or both are directionally configured to allow coupled rotation of the rotation body 340 and second styling module gear 306*b* when the second styling module gear 306*b* is rotated in the fourth direction 327*b*. For example, the groove 338*a*, 338*b* of the stop 375 may be configured for directional passage of the clutch arm 374 when the second styling module gear 306*b* is rotated in the fourth direction 327*b* and the rotation body 340 therefore is rotated in the sixth direction 343*b*. For example, the groove 338*a*, 338*b* may be tapered or smooth to allow the engagement portion to pass over the groove 338*a*, 338*b* and abutment surface 376 for coupled rotation with the second styling module gear 306*b* when the second styling module gear 306*b* rotates in the fourth direction 327*b*. The groove 338*a*, 338*b* may include an arcuate surface that includes a upwardly decreasing depth and width. The arcuate surface may include a 90° arcuate wedge defined between radial edges by the abutment surface 376 and an adjacent edge having similar lengths. In one embodiment, the groove 338*a*, 338*b* is configured to route the clutch arm 374 around the abutment surface 376. The engagement portion of the clutch arm 374 further includes a second surface 378. The second surface 378 is configured to pass over the abutment surface 376 when the rotation body 340 rotates in the sixth direction 343*b* to allow coupled rotation of the rotation body 340 and the second styling module gear 306*b*. The first and second surfaces 377, 378 may be angled or included to assist in decoupled rotation in the fifth direction 343*a* and to allow coupled rotation in the sixth direction 343*b*. For example, the first surface 377 may be angled to include a surface perpendicular to the fifth direction 343*a* or the abutment surface 376 and the second surface 378 may be angled such that the clutch arm 374 may be compressed or counter biased away from locking engagement with the abutment surface 376 or stop 375 by the rotation body 340 to allow passage for coupled rotation in the sixth direction 343*b*.

In various embodiments, when the second styling module 303*b* is received by the holder 302, the decoupling module 373 may be configured to engage to decouple rotation of the second styling module gear 306*b* relative to the rotation body 340 when the second styling module gear 306*b* is rotated in the third direction 327*a* and to disengage to allow coupled rotation of the second styling module gear 306*b* and rotation body 340 when the second styling module gear 306*b* is rotated in the fourth direction 327*b*. The coupling module 365 may be configured to engage to couple rotation of the rotation body 340 and the second styling module gear 306*b* when the second styling module gear 306*b* is rotated in the fourth direction 327*b* and to disengage to allow decoupled rotation of the second styling module gear 306*b* relative to the rotation body 340 when the second styling module gear 306*b* is rotated in the third direction 327*a*.

In various embodiments, when the second styling module gear 306*b* is rotated in the third direction 327*a*, the decoupling module 373 is configured to engage and the coupling module 365 is configured to disengage for decoupled rotation of the second styling module gear 306*b* from the rotation body 340 to allow the twist assemblies 341*a*, 341*b* to rotate 344*a*, 344*b* on their axis T1, T2 to twist separate locks of hair 332*a*, 332*b*. When the second styling module gear 306*b* is rotated in the fourth direction 327*b*, the decoupling module 373 is configured to disengage to allow the coupled rotation of the second styling module gear 306*b* and rotation body 340 and co-rotation of the twist assemblies 341*a*, 341*b* with the rotation body 340 about the third axis R to cable hair 330*a*, 330*b* retained at the grabbers 342*a*, 342*b* and form a cord of hair. It is to be understood that the entire twist assembly 341*a*, 341*b* need not in all embodiments rotate when a twist assembly 341*a*, 341*b* rotates on its axis T1, T2. Rather, rotation of the twist assemblies 341*a*, 341*b* may refer to resultant rotation of the grabbers 342*a*, 342*b* via rotation of the grabber gears. In one embodiment, the third direction 327*a* corresponds to the fifth direction and the fourth direction 327*b* corresponds to the sixth direction. It is also to be understood that in certain embodiments the directions of rotation of the twist assemblies 341*a*, 341*b* about their respective axes T1, T2 and the rotation of the rotation body 340 about the third axis R may be the same or different. Similarly, the direction of rotation of the second styling module gear 306*b* may be the same or different than the directions of rotation of either the twist assemblies 341*a*, 341*b* or the rotation body 340.

The matter set forth in the foregoing description and accompanying drawings is offered by way of illustration only and not as a limitation. While the systems and apparatuses have been described and illustrated in connection with certain embodiments, many variations and modifications will be evident to those skilled in the art and may be made without departing from the spirit and scope of the disclosure. For example, the systems and apparatuses disclosed herein have been identified, adapted to, and designed for hair styling. In one form, this disclosed subject matter may be used to improve hair styling for home or professional applications. Those having skill in the art will understand upon reading the present disclosure that the subject matter may be applied to additional hair styling operations. The disclosure is thus not to be limited to the precise details of methodology or construction set forth above as such variations and modification are intended to be included within the scope of the disclosure.

What is claimed is:

1. A hair styling system, the system comprising:

a driver module comprising a holder configured to interchangeably receive a plurality of styling modules, each configured to perform at least one styling operation, a driver gear positioned adjacent to the holder, and a power module comprising a motor configured to drive the driver gear in a first direction and a second direction; and a plurality of interchangeably receivable styling modules each comprising a styling module gear configured to operatively engage the driver gear and be rotatable thereby to perform at least one styling operation distinguishable from a styling operation performed by at least one other styling module, wherein the styling module gear of each of the plurality of styling modules is configured to rotate in a third direction when the driver gear is driven in the first direction and in a fourth direction when the driver gear is driven in the second direction, and wherein the plurality of interchangeably receivable styling modules comprises a first styling module comprising a first styling module gear, wherein the first styling module is configured to perform a first styling operation when the first styling module gear is rotated in at least one of the third direction and the fourth direction, and a second styling module comprising a second styling module gear, wherein the second styling module is configured to perform at least one of a second styling operation when the second styling module gear is rotated in the third direction and a third styling operation when the second styling module gear is driven in the fourth direction.

2. The hair styling system of claim 1, wherein the second styling module is configured to perform both the second and third styling operations, and wherein the first styling operation, the second styling operation, and the third styling operation are distinguishable.

3. The hair styling system of claim 2, wherein the first styling operation comprises wrapping a lock of hair with a cord when the first styling module gear is rotated in at least one of the third direction and the fourth direction, wherein the second styling operation comprises twisting at least two separate locks of hair when the second styling module gear is rotated in the third direction, and wherein the third styling operation comprises twining at least two separate locks of hair together when the second styling module gear is rotated in the fourth direction.

4. The hair styling system of claim 3, wherein the first styling module further comprises a rotation body rotationally coupled to the first styling module gear and a spool rotatably mounted with respect to the first styling module gear and rotation body, the spool configured to retain a length of cord configured to be dispensed from the spool when the spool rotates relative to the rotation body and be threaded through a slot defined on the rotation body such that rotation of the rotation body rotates the cord with the rotation of the rotation body to wrap the cord about a lock of hair.

5. The hair styling system of claim 1, wherein the second styling module further comprises:

a shaft rotationally coupled to the second styling module gear, wherein the shaft and the second styling module gear are configured to rotate in a third direction relative to the holder when the driver gear is driven in the first direction and in a fourth direction relative to the holder when the driver gear is driven in the second direction;

a rotation body rotatably coupled to the second styling module gear and shaft; and at least a first and second twist assembly, each comprising a grabber configured to grab one or more locks of hair, wherein the first and second twist assemblies are each drivable by rotation of the shaft to rotate about a respective first and second twist axis to perform the second styling operation, and wherein the first and second twist assemblies are rotationally coupled to the rotation of the rotation body to co-rotate about a third axis when the rotation body rotates relative to the holder to perform the third styling operation.

6. The hair styling system of claim 5, wherein, when the second styling module is received by the holder, the hair styling system comprises one or more directional clutches configured to decouple rotation of the second styling module gear from the rotation body when the second styling module gear is rotated in the third direction to perform the second styling operation and couple rotation of the second styling module gear to the rotation body when the second styling module gear is rotated in the fourth direction to perform the third styling operation.

7. The hair styling system of claim 5, wherein when the second styling module is received by the holder, the hair styling system comprises a decoupling module configured to engage to decouple rotation of the second styling module gear relative to the rotation body when the second styling module gear is rotated in the third direction and to disengage to allow coupled rotation of the second styling module gear and rotation body when the second styling module gear is rotated in the fourth direction.

8. The hair styling system of claim 7, wherein the decoupling module comprises at least one clutch arm extending from the driver module and configured to engage at least one first stop defined on the rotation body when the second styling module is received by the holder, wherein the at least one first stop comprises a groove extending to an abutment surface configured to cooperatively engage with an engagement portion of the clutch arm to oppose rotation of the rotation body in a fifth direction about the third axis relative to the holder when the second styling module gear is rotated in the third direction, and wherein the at least one clutch arm is configured to pass over the groove and abutment surface to allow rotation of the rotation body relative to the holder in a sixth direction when the second styling module gear is rotated in the fourth direction.

9. The hair styling system of claim 8, wherein the third direction corresponds to the fifth direction and the fourth direction corresponds to the sixth direction.

10. The hair styling system of claim 5, wherein the second styling module comprises a coupling module configured to engage to couple rotation of the second styling module gear to the rotation body when the second styling module gear is rotated in the fourth direction and to disengage to allow decoupled rotation of the second styling module gear relative to the rotation body when the second styling module gear is rotated in the third direction.

11. The hair styling system of claim 10, wherein the coupling module comprises at least one clutch arm extending between the second styling module gear and the rotation body and at least one stop comprising an abutment surface configured to be engaged by an engagement portion of the at least one clutch arm when the second styling module gear is rotated in the fourth direction to couple the rotation of the second styling module gear to the rotation body, and wherein the at least one clutch arm and the at least one stop are dimensioned for passage of the engagement portion with respect to the at least one stop when the second styling module gear is rotated in the third direction to allow decoupled rotation of the second styling module gear with respect to the rotation body.

12. The hair styling system of claim 11, wherein the at least one stop comprises:

a groove defined in a surface of the rotation body and having depth with respect to the surface of the rotation body that increases from a first end to a second end; and an abutment surface formed at the second end of the groove, wherein the at least one clutch arm is mounted on the second styling module gear and is configured to be biased into the groove to engage the abutment surface when the second styling module gear is rotated in the fourth direction to couple rotation of the second styling module gear with the rotation body, and wherein the at least one clutch arm slides along the surface of the rotation body, over the engagement surface, and through the groove when the second styling module gear is rotated in the third direction relative to the rotation body.

13. The hair styling system of claim 5, wherein when the second styling module is received by the holder, the hair styling system comprises a decoupling module and a coupling module, wherein the decoupling module comprises at least one first clutch arm is configured to engage to decouple rotation of the second styling module gear relative to the rotation body when the second styling module gear is rotated in the third direction and to disengage to allow coupled rotation of the second styling module gear and rotation body when the second styling module gear is rotated in the fourth direction, and wherein the coupling module comprises at least one second clutch arm configured to engage to couple rotation of the rotation body and the second styling module gear when the second styling module gear is rotated in the fourth direction and to disengage to allow decoupled rotation of the second styling module gear relative to the rotation body when the second styling module gear is rotated in the third direction.

14. The hair styling system of claim 13, wherein the driver module further comprises a latch positioned adjacent to the holder and configured to be biased toward a surface of a styling module received therein, wherein the latch is operatively coupled to an actuator configured to counter bias the latch away from the surface of the styling module when actuated, wherein, when the first styling module is received by the holder, the latch is configured to oppose a lip defined on an outer surface of the first styling module to retain the first styling module on the holder, and wherein, when the second styling module is received by the holder, the latch comprises the at least one first clutch arm.

15. A hair styling apparatus comprising:

a driver module comprising a holder configured to interchangeably receive a plurality of styling modules, each configured to perform at least one styling operation;

a driver gear positioned adjacent to the holder; and a power module comprising a motor configured to drive the driver gear in a first direction and a second direction; and a plurality of interchangeably receivable styling modules each comprising a styling module gear configured to operatively engage the driver gear and be rotatable thereby to perform at least one styling operation distinguishable from a styling operation performed by at least one other styling module, wherein the styling module gear of each of the plurality of styling modules is configured to rotate in a third direction when the driver gear is driven in the first direction and in a fourth direction when the driver gear is driven in the second direction, and wherein the plurality of interchangeably receivable styling modules comprises a first styling module comprising a first styling module gear, wherein the first styling module is configured to perform a first styling operation when the first styling module gear is rotated in at least one of the third direction and the fourth direction, and a second styling module comprising a second styling module gear, wherein the second styling module is configured to perform a second styling operation when the second styling module gear is rotated in the third direction and a third styling operation when the second styling module gear is driven in the fourth direction.

16. The hair styling apparatus of claim 15, wherein the second styling module further comprises:

a shaft rotationally coupled to the second styling module gear, wherein the shaft and the second styling module gear are configured to rotate in a third direction relative to the holder when the driver gear is driven in the first direction and in a fourth direction, opposite the third direction, relative to the holder when the driver gear is driven in the second direction;

a rotation body rotatably coupled to the second styling module gear and shaft; and at least a first and second twist assembly, each comprising a grabber configured to grab one or more locks of hair, wherein the first and second twist assemblies are each drivable by rotation of the shaft to rotate about a respective first and second twist axis independent of a rotation of the rotation body to perform the second styling operation when the second styling module gear is rotated in the third direction, wherein the first and second twist assemblies are rotationally coupled to the rotation of the rotation body to co-rotate about a third axis when the rotation body rotates relative to the holder to perform the third styling operation when the second styling module gear rotates in the fourth direction, and wherein the driver module further comprises a latch positioned adjacent to the holder and configured to be biased toward a surface of a styling module received therein, wherein the latch is operatively coupled to an actuator configured to counter bias the latch away from the surface of the styling module when actuated, wherein, when the first styling module is received by the holder, the latch is configured to oppose a lip defined on an outer surface of the first styling module to retain the first styling module on the holder, and wherein, when the second styling module is received by the holder, the latch comprises a clutch arm configured to engage a stop defined in a surface of the second styling module to decouple rotation of second styling module gear with respect to the rotation body when the second styling module gear is rotated in the third direction.

17. A hair styling module comprising, a styling module gear;

a shaft rotationally coupled to a styling module gear;

a rotation body rotatably coupled to the styling module gear and shaft and rotatable about a rotation axis; and at least a first and a second twist assembly, wherein the first and second twist assemblies are rotatable about a respective first and second twist axis when the styling module gear and shaft rotate relative to the rotation body to perform a first styling operation, and wherein the first and second twist assemblies are rotationally coupled to the rotation body to co-rotate about the rotation axis when the rotation body rotates about the rotation axis to perform a second styling operation; and wherein the hair styling module is configured to be selectively received a driver module comprising a holder configured to interchangeably receive the styling module and at least one other styling module, each configured to perform at least one styling operation, a driver gear positioned adjacent to the holder and configured to drivably engage the styling module gear when the hair styling module is received by the holder, and a power module comprising a motor configured to drive the driver gear to rotate the styling module gear in the first direction to perform the first styling operation and the second direction to perform the second styling operation.

18. The hair styling module of claim 17, further comprising:

a coupling assembly configured to allow relative rotation between the styling module gear and the rotation body when the styling module gear is rotated in a first direction and to couple rotation of the styling module gear to the rotation body when the styling module gear is rotated in a second direction; and a first decoupling assembly portion configured to cooperatively interface with a second decoupling assembly portion attached to the holder when the hair styling module is received thereby, the first decoupling assembly portion comprising a stop having a groove and an abutment surface positioned on an outer surface of the rotation body, wherein the second decoupling assembly portion comprises a clutch arm configured to be biased into the groove such that the abutment surface catches the clutch arm when the styling module gear is rotated in the first direction to prevent the rotation body from rotating in the first direction with the styling module gear, and wherein the stop is configured to counter bias the clutch arm when the styling module gear is rotated in the second direction to allow the rotation of the styling module gear in the second direction to be coupled to the rotation body.

* * * * *